US011311435B2

(12) United States Patent
Dimitrov

(10) Patent No.: US 11,311,435 B2
(45) Date of Patent: Apr. 26, 2022

(54) FRAME FOR UTILIZATION WITH COMPONENTS OF WHEELCHAIR

(71) Applicant: Dimitre Petkov Dimitrov, Toronto (CA)

(72) Inventor: Dimitre Petkov Dimitrov, Toronto (CA)

( * ) Notice: Subject to any disclaimer, the term of this patent is extended or adjusted under 35 U.S.C. 154(b) by 273 days.

(21) Appl. No.: 16/496,568

(22) PCT Filed: Apr. 17, 2018

(86) PCT No.: PCT/CA2018/050458

§ 371 (c)(1),
(2) Date: Sep. 23, 2019

(87) PCT Pub. No.: WO2018/201228

PCT Pub. Date: Nov. 8, 2018

(65) Prior Publication Data

US 2021/0290461 A1 Sep. 23, 2021

Related U.S. Application Data

(60) Provisional application No. 62/500,214, filed on May 2, 2017.

(51) Int. Cl.
*A61G 5/10* (2006.01)
*A61G 5/04* (2013.01)

(52) U.S. Cl.
CPC ..... *A61G 5/1054* (2016.11); *A61G 5/047* (2013.01); *A61G 5/1051* (2016.11); *A61G 5/1083* (2016.11); *A61G 5/1089* (2016.11)

(58) Field of Classification Search
CPC .. A61G 5/0875; A61G 5/1083; A61G 5/1089; A61G 5/1054; A61G 5/08
See application file for complete search history.

(56) References Cited

U.S. PATENT DOCUMENTS 2,329,823 A 9/1943 Camburn
3,485,510 A 12/1969 Merlan
3,580,591 A 5/1971 Coffey et al.
(Continued)

FOREIGN PATENT DOCUMENTS

CA 2992248 3/2017
CN 203138890 U 8/2013
(Continued)

OTHER PUBLICATIONS

Kristian MacKenzie, "International Search Report for PCT/CA2018/050458", dated Jul. 5, 2018.
(Continued)

*Primary Examiner* — Minnah L Seoh
*Assistant Examiner* — Harold Eric Pahlck, III
(74) *Attorney, Agent, or Firm* — Rumit Ranjit Kanakia

(57) ABSTRACT

An apparatus includes a frame assembly configured to be selectively connectable with a seat assembly of a wheelchair assembly once the seat assembly is selectively disconnected and removed from the wheelchair assembly. The frame assembly is also configured to be selectively connectable with spaced-apart wheel assemblies of the wheelchair assembly once the spaced-apart wheel assemblies are selectively disconnected and removed from the wheelchair assembly.

20 Claims, 9 Drawing Sheets

(56) References Cited

U.S. PATENT DOCUMENTS

| | | | | |
|---|---|---|---|---|
| 3,618,968 | A | 11/1971 | Greer | |
| 3,679,257 | A | 7/1972 | Jacuzzi et al. | |
| 3,901,527 | A | 8/1975 | Dangizer et al. | |
| 3,953,054 | A | 4/1976 | Udden et al. | |
| 4,085,946 | A | 4/1978 | Krupp | |
| 4,310,167 | A | 1/1982 | McLaurin | |
| 4,316,616 | A | 2/1982 | Boivin | |
| 4,405,142 | A | 9/1983 | Whetstine | |
| 4,471,972 | A | 9/1984 | Young | |
| 4,720,117 | A | 1/1988 | Hay | |
| 4,852,899 | A | 8/1989 | Kueschall | |
| 4,989,890 | A | 2/1991 | Lockard et al. | |
| 5,176,393 | A | 1/1993 | Robertson et al. | |
| 5,209,506 | A | 5/1993 | Klopfenstein | |
| 5,222,567 | A | 6/1993 | Broadhead et al. | |
| 5,273,304 | A | 12/1993 | Berkheimer | |
| 5,280,937 | A | 1/1994 | Needham | |
| 5,484,152 | A | 1/1996 | Nunes et al. | |
| 5,605,345 | A | 2/1997 | Erfurth et al. | |
| D380,991 | S | 7/1997 | Deming | |
| 5,651,422 | A | 7/1997 | Casali | |
| 5,667,235 | A | 9/1997 | Pearce et al. | |
| 5,884,928 | A | 3/1999 | Papac | |
| 5,947,562 | A * | 9/1999 | Christofferson | A61G 5/1075 297/440.22 |
| 6,129,165 | A | 10/2000 | Schaffner et al. | |
| 6,176,335 | B1 | 1/2001 | Schaffner et al. | |
| 6,199,647 | B1 | 3/2001 | Schaffner et al. | |
| 6,264,218 | B1 | 7/2001 | Slagerman | |
| 6,543,798 | B2 | 4/2003 | Schaffner et al. | |
| 6,766,871 | B2 | 7/2004 | Sawyer | |
| 7,192,043 | B1 * | 3/2007 | McLuen | A61G 5/08 280/250.1 |
| 7,219,924 | B2 | 5/2007 | Mulhern et al. | |
| 7,584,976 | B2 | 9/2009 | Bayne et al. | |
| 8,152,192 | B2 | 4/2012 | Dougherty | |
| 8,973,935 | B2 | 3/2015 | Salvan | |
| 9,308,142 | B2 | 4/2016 | Harding | |
| D780,642 | S | 3/2017 | Karshmer et al. | |
| 9,700,469 | B2 | 7/2017 | Golden, Jr. | |
| 9,795,522 | B2 * | 10/2017 | Hansen | A61G 5/0825 |
| 2003/0168264 | A1 | 9/2003 | Goertzen et al. | |
| 2005/0093270 | A1 | 5/2005 | Wilcox et al. | |
| 2006/0042891 | A1 | 3/2006 | Larson et al. | |
| 2007/0096427 | A1 | 5/2007 | Knaub | |
| 2007/0126206 | A1 | 6/2007 | Nash | |
| 2009/0166996 | A1 * | 7/2009 | Spindle | A61G 5/0883 280/250.1 |
| 2013/0015632 | A1 | 1/2013 | Winter et al. | |
| 2015/0001833 | A1 | 1/2015 | Golden, Jr. | |
| 2016/0143793 | A1 * | 5/2016 | Holub | A61G 5/0875 297/311 |
| 2017/0367912 | A1 | 12/2017 | Chiang | |

FOREIGN PATENT DOCUMENTS

| | | | |
|---|---|---|---|
| CN | 205729649 | U | 11/2016 |
| DE | 102007062654 | | 8/2009 |
| EP | 2389912 | B1 | 11/2011 |
| EP | 2826453 | A1 | 1/2015 |
| WO | 9411235 | A1 | 5/1994 |
| WO | 2017037648 | A1 | 3/2017 |

OTHER PUBLICATIONS

Kristian MacKenzie, "Written Opinon of the ISA for PCT/CA2018/050458", dated Jul. 5, 2018.

"Titan P22", retrieved Feb. 9, 2018 from http://www.drivemedical.com/index.php/titan-p22-2941.html.

"Smart Drive", retrieved May 2, 2017 from http://permobil.ca/product/smartdrive-mx2-pushtracker/.

"Free Wheel", retrieved May 2, 2017 from http://www.gofreewheel.com/.

"Batec Mobility", retrieved May 2, 2017 from https://batec-mobility.com/en/.

* cited by examiner

FRAME FOR UTILIZATION WITH COMPONENTS OF WHEELCHAIR

TECHNICAL FIELD

This document relates to the technical field of (and is not limited to) a frame assembly configured for utilization with components of a wheelchair assembly once the wheelchair assembly is taken apart (and method therefor). More specifically, this document relates to the technical field of (and is not limited to) a frame assembly for utilization with a seat assembly and spaced-apart wheel assemblies of a wheelchair assembly once the seat assembly and the spaced-apart wheel assemblies are selectively removed from the wheelchair assembly (and method therefor).

BACKGROUND

FIG. 1, FIG. 2, FIG. 3, FIG. 4, FIG. 5 and FIG. 6 depict a rear perspective view (FIG. 1), a side view (FIG. 2), a partially-exploded rear perspective view (FIG. 3), a rear perspective view (FIG. 4), a rear perspective view (FIG. 5), and a rear perspective view (FIG. 6) of embodiments of a known wheelchair assembly 900 (hereafter referred to as the wheelchair assembly 900). The wheelchair assembly includes a seat assembly with wheel assemblies, and is utilized when walking is difficult or impossible due to illness, injury, or disability.

SUMMARY

It will be appreciated that there exists a need to mitigate (at least in part) at least one problem associated with the existing (known) wheelchair assemblies (also called the existing technology). After much study of the known systems and methods with experimentation, an understanding (at least in part) of the problem and its solution has been identified (at least in part) and is articulated (at least in part) as follows:

Users of known wheelchair assemblies may prefer to remain physically active. These users may need viable options for utilizing their existing wheelchairs to further their athletic goals. These users may need viable options for adapting (replacing) their existing wheelchair for specific athletic or sporting objectives (swapping out components of their existing wheelchair for installation to a frame assembly that is more suitable for sporting tasks).

To mitigate, at least in part, at least one problem associated with the existing technology, there is provided (in accordance with a first major aspect) an apparatus. The apparatus includes and is not limited to (comprising) a frame assembly configured to be selectively connectable with a seat assembly of a wheelchair assembly once the seat assembly is selectively disconnected and removed from the wheelchair assembly. The frame assembly is also configured to be selectively connectable with spaced-apart wheel assemblies of the wheelchair assembly once the spaced-apart wheel assemblies are selectively disconnected and removed from the wheelchair assembly. For instance, in accordance with an embodiment (and not limited thereto), the frame assembly is configured to provide an option for utilizing selected components of the wheelchair assembly so that the frame assembly is utilizable for specific athletic or sporting objectives by swapping out components of the wheelchair assembly for installation to the frame assembly that is configured for sporting functions (events). It will be appreciated that the frame assembly may be utilized for (designed or configured for) non-sporting functions (events, situations) if so desired (such as, recreational uses or for cases where additional wheelchair stability may be desired or wanted (when compared to the attributes of the wheelchair assembly).

To mitigate, at least in part, at least one problem associated with the existing technology, there is provided (in accordance with a second major aspect) an apparatus. The apparatus includes and is not limited to (comprising) a frame assembly. Spaced-apart frame connector points are fixedly attached to (and supported by and extend from) the frame assembly. The spaced-apart frame connector points are configured to be selectively connectable with a seat assembly and with spaced-apart wheel assemblies of a wheelchair assembly once the seat assembly and the spaced-apart wheel assemblies are selectively disconnected and removed from the wheelchair assembly. The spaced-apart frame connector points are also configured to be selectively disconnected from the seat assembly and from the spaced-apart wheel assemblies of the wheelchair assembly so that the seat assembly and the spaced-apart wheel assemblies are selectively reconnectable with the wheelchair assembly. The frame assembly is configured to provide an option for utilizing selected components of the wheelchair assembly so that the frame assembly is utilizable for specific athletic or sporting objectives by swapping out components of the wheelchair assembly for installation to the frame assembly that is configured for sporting functions (events).

To mitigate, at least in part, at least one problem associated with the existing technology, there is provided (in accordance with a third major aspect) an apparatus. The apparatus includes and is not limited to (comprising) a frame assembly configured for utilization with components of a wheelchair assembly. The wheelchair assembly includes a first wheel assembly and a second wheel assembly. The first wheel assembly and the second wheel assembly are configured to be selectively disconnectable from the wheelchair assembly. The wheelchair assembly includes a seat assembly configured to be selectively disconnectable from the wheelchair assembly. The frame assembly includes an elongated tubular frame member. The frame assembly also includes a first wheel mount extending from the elongated tubular frame member. The first wheel mount is configured to securely rotatably receive and support the first wheel assembly of the wheelchair assembly once the first wheel assembly is selectively disconnected from the wheelchair assembly. The frame assembly also includes a second wheel mount extending from the elongated tubular frame member. The second wheel mount is configured to securely rotatably receive and support the second wheel assembly of the wheelchair assembly once the second wheel assembly is disconnected from the wheelchair assembly. The second wheel mount and the first wheel mount are spaced apart from each other. The frame assembly also includes a third wheel tubular mount extending from the elongated tubular frame member. The third wheel tubular mount is configured to securely rotatably receive and support an auxiliary wheel assembly at a spaced-apart relationship relative to the first wheel assembly and the second wheel assembly of the wheelchair assembly. The frame assembly is configured to provide an option for utilizing selected components of the wheelchair assembly so that the frame assembly is utilizable for specific athletic or sporting objectives by swapping out components of the wheelchair assembly for installation to the frame assembly that is configured for sporting functions (events).

To mitigate, at least in part, at least one problem associated with the existing technology, there is provided (in accordance with a fourth major aspect) a method. The method is for assembling an apparatus. The method includes and is not limited to (comprising) selectively connecting a frame assembly with a seat assembly of a wheelchair assembly once the seat assembly is selectively disconnected and removed from the wheelchair assembly. The method also includes selectively connecting the frame assembly with spaced-apart wheel assemblies of the wheelchair assembly once the spaced-apart wheel assemblies are selectively disconnected and removed from the wheelchair assembly. The method provides an option for utilizing selected components of the wheelchair assembly so that the frame assembly is utilizable for specific athletic or sporting objectives by swapping out components of the wheelchair assembly for installation to the frame assembly that is configured for sporting functions (events).

To mitigate, at least in part, at least one problem associated with the existing technology, there is provided (in accordance with a fifth major aspect) a method. The method is for assembling an apparatus. The method includes and is not limited to (comprising) selectively connecting spaced-apart frame connector points with a seat assembly and with spaced-apart wheel assemblies of a wheelchair assembly once the seat assembly and the spaced-apart wheel assemblies are selectively disconnected and removed from the wheelchair assembly, in which the spaced-apart frame connector points are fixedly attached to (and supported by and extend from) a frame assembly. The method includes and is not limited to (comprising) selectively disconnecting the spaced-apart frame connector points from the seat assembly and from the spaced-apart wheel assemblies of the wheelchair assembly so that the seat assembly and the spaced-apart wheel assemblies are selectively reconnectable with the wheelchair assembly. The method provides an option for utilizing selected components of the wheelchair assembly so that the frame assembly is utilizable for specific athletic or sporting objectives by swapping out components of the wheelchair assembly for installation to the frame assembly that is configured for sporting functions (events).

To mitigate, at least in part, at least one problem associated with the existing technology, there is provided (in accordance with a sixth major aspect) a method. The method is for assembling an apparatus. The method includes and is not limited to (comprising) selectively connecting a first wheel mount to a first wheel assembly of a wheelchair assembly once the first wheel assembly is selectively disconnected from the wheelchair assembly. The first wheel mount extends from a frame assembly configured for utilization with components of the wheelchair assembly. The wheelchair assembly includes the first wheel assembly and a second wheel assembly. The first wheel assembly and the second wheel assembly are configured to be selectively disconnectable from the wheelchair assembly. The wheelchair assembly includes a seat assembly configured to be selectively disconnectable from the wheelchair assembly. The frame assembly includes an elongated tubular frame member. The first wheel mount extends from the elongated tubular frame member. The method also includes and is not limited to (comprising) selectively connecting a second wheel mount to the second wheel assembly of the wheelchair assembly once the second wheel assembly is disconnected from the wheelchair assembly. The second wheel mount extends from the elongated tubular frame member. The second wheel mount and the first wheel mount are spaced apart from each other. The method also includes and is not limited to (comprising) selectively connecting a third wheel tubular mount to an auxiliary wheel assembly at a spaced-apart relationship relative to the first wheel assembly and the second wheel assembly of the wheelchair assembly. The third wheel tubular mount extends from the elongated tubular frame member. The method provides an option for utilizing selected components of the wheelchair assembly so that the frame assembly is utilizable for specific athletic or sporting objectives by swapping out components of the wheelchair assembly for installation to the frame assembly that is configured for sporting functions (events).

To mitigate, at least in part, at least one problem associated with the existing technology, there is provided (in accordance with a seventh major aspect) an apparatus. The apparatus includes and is not limited to (comprising) a frame assembly having a seat assembly. The frame assembly also has spaced-apart wheel assemblies. Various components of the frame assembly are described in the detailed description below.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
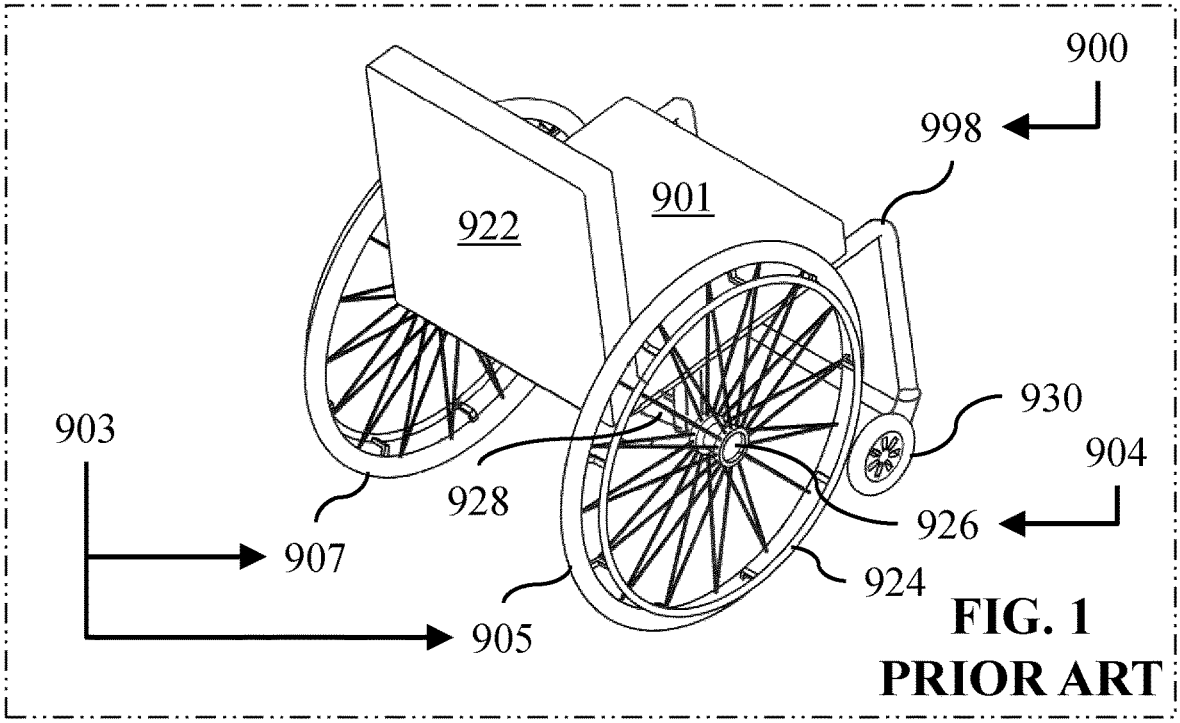
FIG. 1 PRIOR ART
FIG. 1 depicts a rear perspective view of a prior-art wheelchair assembly.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 frame assembly
101 spaced-apart frame connector points
102 spaced-apart seat connector points
104 spaced-apart wheel connector points
200 U-shaped frame
900 wheelchair assembly
901 seat assembly
902 spaced-apart seat-connection points
903 spaced-apart wheel assemblies
904 spaced-apart wheel-connection points
905 first wheel assembly
906 auxiliary wheel assembly
907 second wheel assembly
908 common rotation axis
909 auxiliary rotation axis
911 first wheel mount
912 second wheel mount
913 third wheel tubular mount
914 swivel fork
915 fork hub
922 backrest assembly
924 manual push rail
926 wheel hub
928 wheel axle
929 user
930 spaced-apart caster wheels
931 wheel connectors
932 seat-connector assembly
933 seat strut
934 spaced-apart axle connector assemblies (or spaced-apart axle hubs)
935 seat hub
936 spaced-apart front axle hubs
937 spaced-apart prongs
938 seat connectors
941 tightening hook
943 hinge
945 clamp assembly
947 tightening handle
949 steering control assembly
950 control device
951 handle
952 pin assembly
953 connecting rod
954 lever
955 control arm
957 connection rod
960 brake lever
961 throttle lever
970 electrical motor
971 electrical battery
990 elongated tubular frame member
998 seat frame

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device configured to be coupled to the item, either directly or indirectly. Therefore, "configured to" may include the meaning "either directly or indirectly" unless specifically stated otherwise.

FIG. 1, FIG. 2, FIG. 3, FIG. 4, FIG. 5 and FIG. 6 depict a rear perspective view (FIG. 1), a side view (FIG. 2), a partially-exploded rear perspective view (FIG. 3), a rear perspective view (FIG. 4), a rear perspective view (FIG. 5), and a rear perspective view (FIG. 6) of embodiments of a known wheelchair assembly 900 (hereafter referred to as the wheelchair assembly 900).

Referring to the embodiments as depicted in FIG. 1, FIG. 2, FIG. 3, FIG. 4, FIG. 5 and FIG. 6, the wheelchair assembly 900 includes (has) a combination of components, such as a seat frame 998 (also called a tubular frame) extending from a seat assembly 901. The seat assembly 901 and the seat frame 998, in use, combine, at least in part, to form a structural-support unit for the wheelchair assembly 900. The seat assembly 901 includes a backrest assembly 922.

Figure 2:
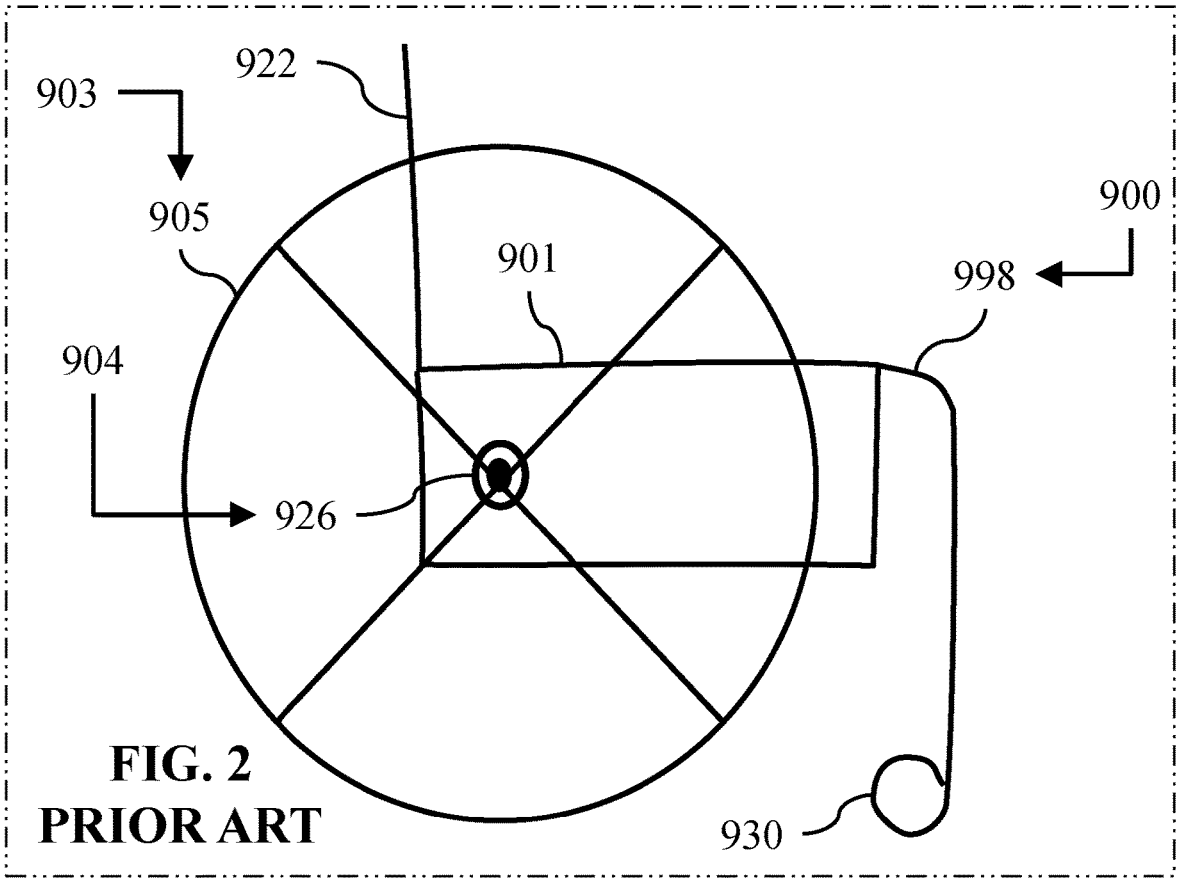
FIG. 2 PRIOR ART
FIG. 2 depicts a side view of a prior-art wheelchair assembly.

Referring to the embodiment as depicted in FIG. 1 and FIG. 2, the wheelchair assembly 900 includes spaced-apart wheel assemblies 903 (such as, the first wheel assembly 905 and the second wheel assembly 907, also called the main supporting wheels). A manual push rail 924 may be mounted to one or both of the first wheel assembly 905 and/or the second wheel assembly 907. Each of the first wheel assembly 905 and the second wheel assembly 907 includes a wheel hub 926 (which are examples of spaced-apart wheel-connection points 904). Each of the first wheel assembly 905 and the second wheel assembly 907 also includes a seat axle 928 (also called an axle, etc.) configured to rotatably connect to the wheel hub 926. Spaced-apart caster wheels 930 (also called front caster wheels) are mounted to distal end sections of the seat frame 998. The spaced-apart caster wheels 930 are configured to contact a working surface (the ground).

Referring to the embodiment as depicted in FIG. 1 and FIG. 2, it will be appreciated that the wheelchair assembly 900 is (geometrically, structurally) configured to position the center of gravity (of the wheelchair assembly 900) at a position (location) that is a longitudinal projection over (above) the ground (working surface) between a point of contact of the spaced-apart wheel assemblies 903 and a point of contact of the spaced-apart caster wheels 930. Moreover, the wheelchair assembly 900 is configured to position the projection of the center of gravity relatively closer to a point of contact where the spaced-apart wheel assemblies 903 contact the working surface.

Referring to the embodiment as depicted in FIG. 1 and FIG. 2, there is depicted the wheelchair assembly 900 with spaced-apart caster wheels 930 (also called the caster wheels or the front caster wheels). The spaced-apart wheel assemblies 903 (also called the main supporting rear wheels) have inherent problems related to the vertical projection of the center of gravity (CG) is very close to the point of contact between the spaced-apart wheel assemblies 903 and the working surface (terrain) thus creating a condition for easy rolling back of the wheelchair assembly 900 for the case where a larger torque is applied to the manual push rail 924 (the push rim) of the spaced-apart wheel assemblies 903, or for the case where the wheelchair assembly 900 is used on a steeper slope.

Referring to the embodiment as depicted in FIG. 1 and FIG. 2, additionally, the spaced-apart caster wheels 930 (the front caster wheels) have a relatively smaller radius. For the case where the spaced-apart caster wheels 930 are placed in front of the wheelchair assembly 900 (the chassis) and in front of the center of gravity, this arrangement creates the condition for the wheelchair assembly 900 getting stuck (that is, being prevented from forward motion) by smaller obstacles, pebbles, or low curbs that happen to be on the path of the spaced-apart caster wheels 930. The same may be true for softer surfaces where the spaced-apart caster wheels 930 may sink deeper when a user of the wheelchair assembly 900 applies a propelling force to the wheelchair assembly 900.

Referring to the embodiment as depicted in FIG. 1 and FIG. 2, it may not be possible to move the center of gravity too far forward as this may further exacerbate the problem with the spaced-apart caster wheels 930 getting stuck, and additionally makes it harder to lift the spaced-apart caster wheels 930 by dynamically applying forward momentum (also known as doing wheelies). Where these stability problems have been addressed, the solutions require compromises with either efficiency of propulsion (for example, for the case where the center of gravity may be moved well in advance of the axle of the spaced-apart wheel assemblies 903, or for the case where the utility of the wheelchair assembly 900 may be compromised where the user has to switch to a specialized types of transport system (such as, a racing chair or a cross-country chair that has larger dimensions).

Referring to the embodiment as depicted in FIG. 1 and FIG. 2, for instance, the existing technical solutions around the stability issues of the classical (traditional, known, typical) manual wheelchair configuration directly affect the range of applications that users of manual wheelchairs can safely experience. This may limit the user's options as to the places they may visit and the distances they may travel without depending on other people to supply transport or handling of specialized chairs. For example, going through soft terrain like snow or mud is very difficult and unstable with a classical configuration of the manual wheelchair. Similarly, going over relatively smaller obstacles (like rail tracks) becomes a major risk for backward roll-over, and even when anti-tipping devices are installed, it only works satisfactorily on hard and even surfaces and also creates a very jarring experience that cannot be sustained for a longer ride, or requires significant application of skill which few users may attain in a safe manner.

Referring to the embodiment as depicted in FIG. 1 and FIG. 2, incidentally, venturing on a longer ride almost certainly puts the user in a situation where they need to cope with at least some of these variations of the terrain and surface, and it is more difficult for the user to negotiate these obstacles compared to when they remain within relatively familiar areas with already familiar obstacles. Users who want to venture on a longer ride with a wheelchair (manual wheelchair) need to use a dedicated specialized wheelchair or install devices which significantly increase the length of the footprint of the chair, which then limits the users from entering many places where the larger footprint wheelchairs cannot fit or are too cumbersome to operate. For the case where users utilize a combination of a known specialized wheelchair for long distances and a known standard wheelchair for indoor usage, this then necessitates the use of a personal motor vehicle in order to transport both the known specialized wheelchairs and standard wheelchairs simultaneously and the ability to interchangeably use each of the chairs based on the situation.

Referring to the embodiment as depicted in FIG. 1 and FIG. 2, known wheelchairs may adequately address some deficiencies, and may exacerbate other deficiencies. For example, adding a larger wheel far ahead of the spaced-apart caster wheels 930 may improve the ability to go over some rough surfaces, but the spaced-apart caster wheels 930 may be lifted thereby moving the projection of the center of gravity even closer to the point of contact of the spaced-apart wheel assemblies 903. Depending on the weight ratio between the spaced-apart wheel assemblies 903 and the occupant of the wheelchair assembly 900, the net effect may often be detrimental to the roll-over stability of the wheelchair assembly 900.

Figure 3:
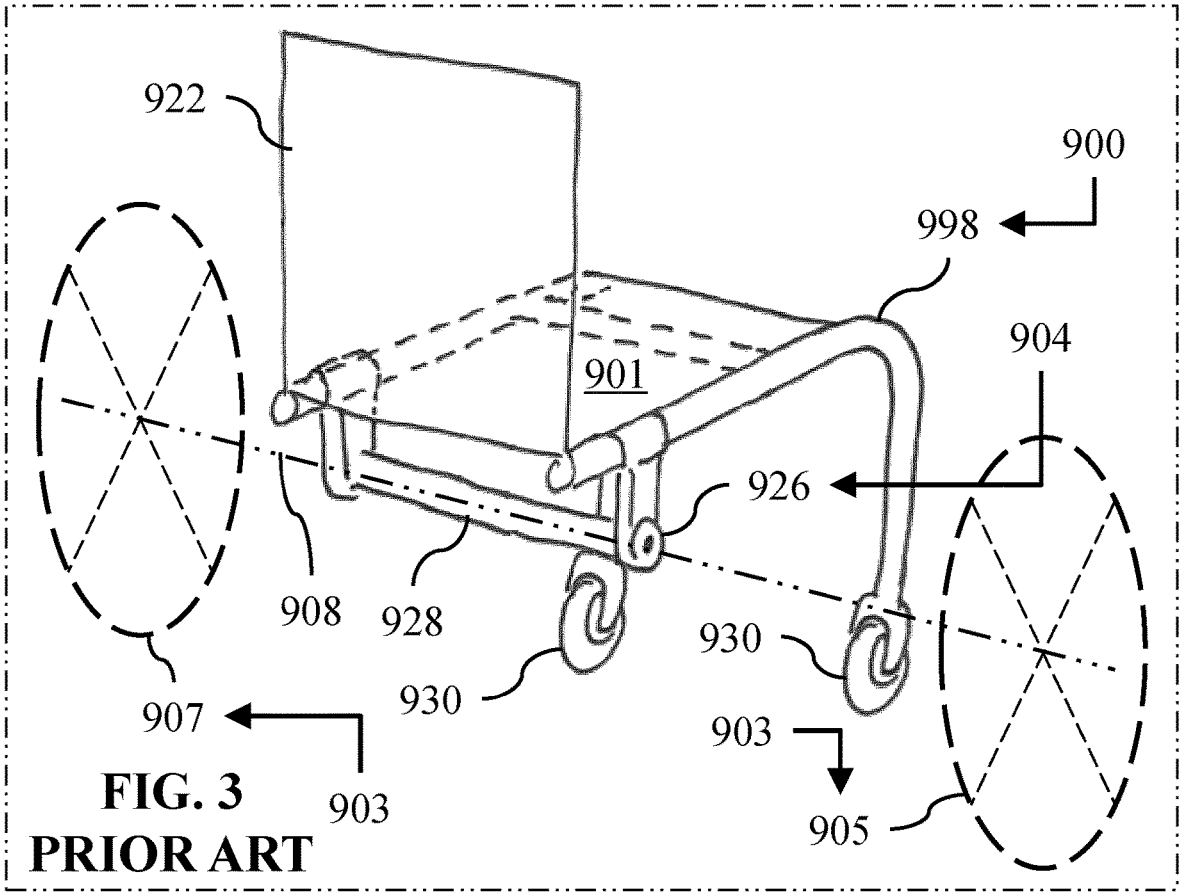
FIG. 3 PRIOR ART
FIG. 3 depicts a partially-exploded rear perspective view of a prior-art wheelchair assembly.
Figure 4:
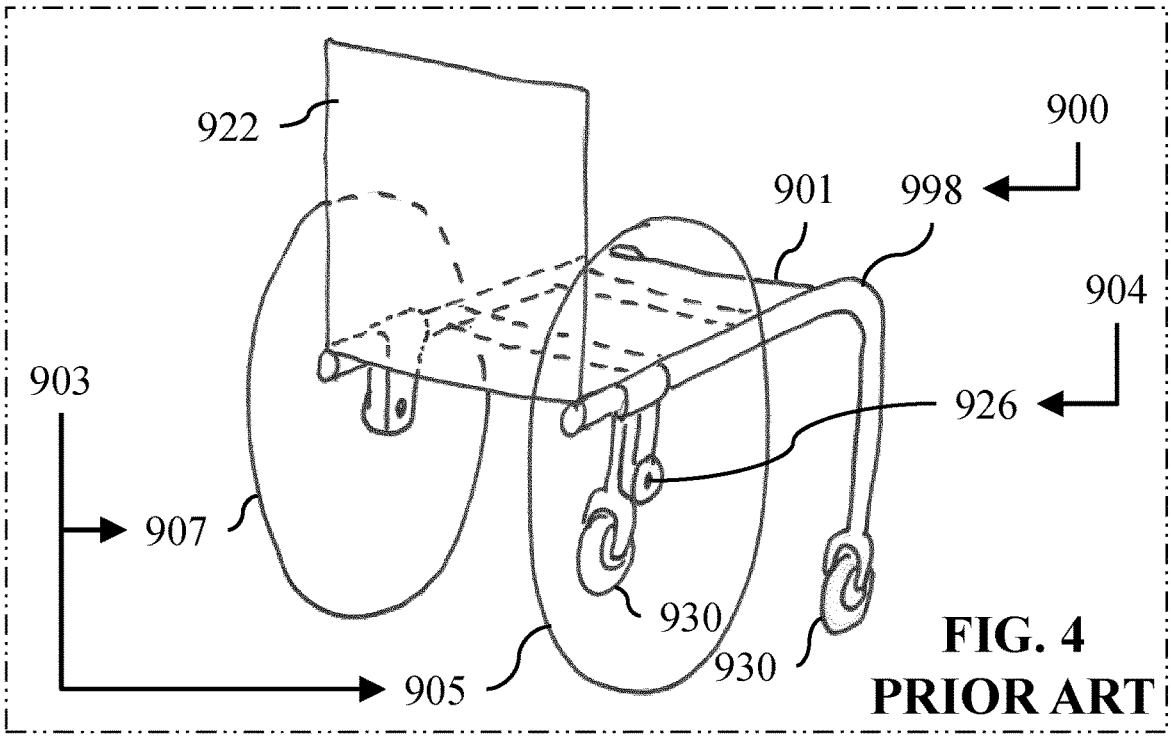
FIG. 4 PRIOR ART
FIG. 4 depicts a rear perspective view of a prior-art wheelchair assembly.

Referring to the embodiment as depicted in FIG. 3 and FIG. 4, the wheelchair assembly 900 includes a rigid frame assembly, so that the wheelchair assembly 900 is configured to be not foldable.

Figure 5:
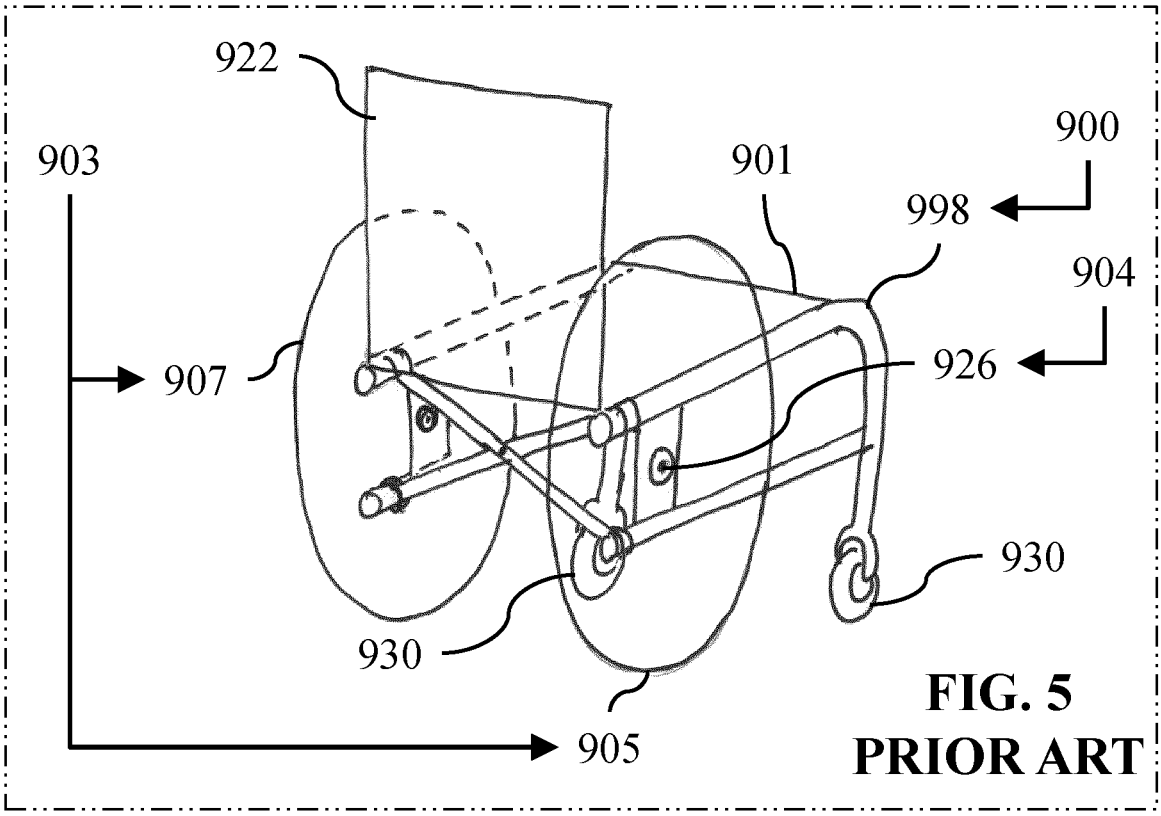
FIG. 5 PRIOR ART
FIG. 5 depicts a rear perspective view of a prior-art wheelchair assembly, and FIG. 6 depict a rear perspective view of a prior-art wheelchair assembly.

Referring to the embodiment as depicted in FIG. 5, the wheelchair assembly 900 includes a foldable frame assembly, so that the wheelchair assembly 900 is configured to be foldable.

Figure 6:
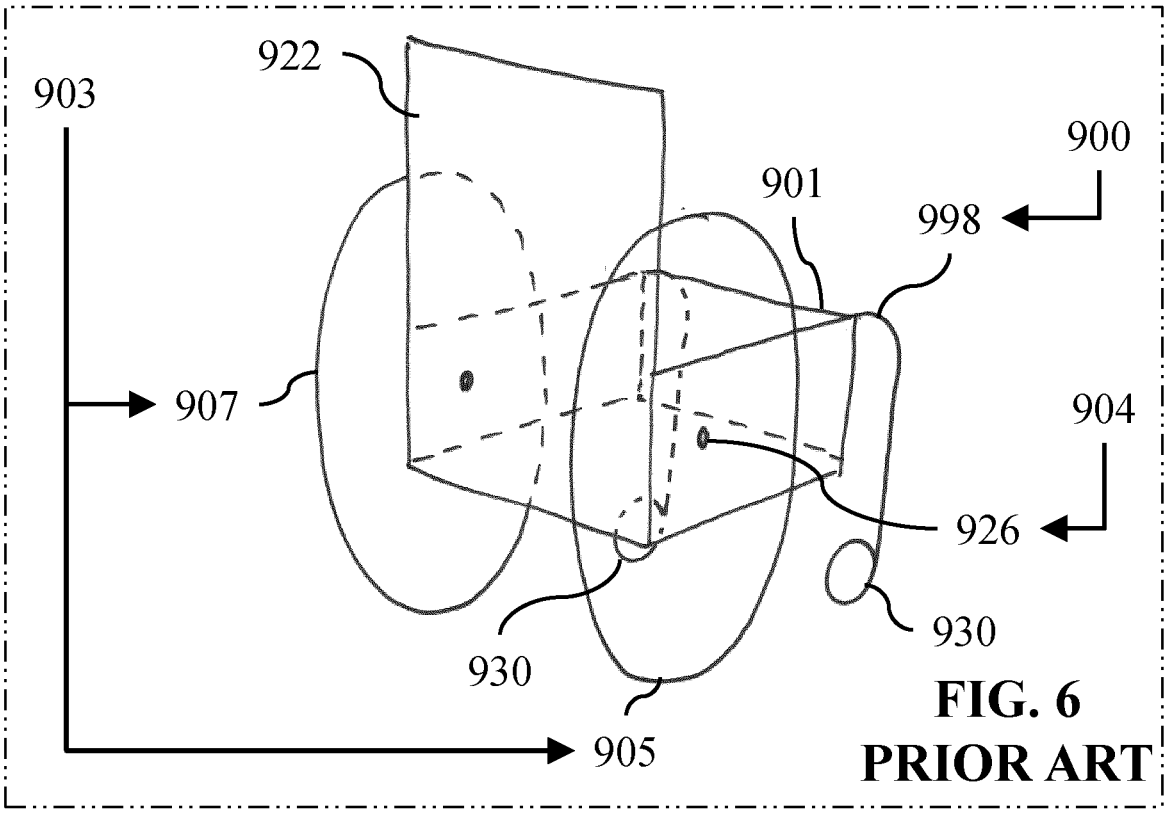
FIG. 6 PRIOR ART

Referring to the embodiment as depicted in FIG. 6, the wheelchair assembly 900 is depicted with a boxed-out footprint (outline) of the wheelchair assembly 900.

FIG. 7 to FIG. 20 depict embodiments of a frame assembly 100 configured for utilization with any one or more of the embodiments of the wheelchair assembly 900 of any one of FIG. 1 to FIG. 6. The wheelchair assembly 900 is disassembled (at least partially) by a user so that the seat assembly 901 and the first wheel assembly 905 are selectively removed (disconnected) from the wheelchair assembly 900. Once removed from the wheelchair assembly 900, the seat assembly 901 and the first wheel assembly 905 are selectively securely connected (by the user) to the frame assembly 100. The frame assembly 100 is configured to selectively securely connect to the seat assembly 901 and the first wheel assembly 905 and the second wheel assembly 907 (and it will be appreciated that the wheelchair assembly 900 is no longer usable once the seat assembly 901 and the first wheel assembly 905 and the second wheel assembly 907 are disconnected from the wheelchair assembly 900). The wheelchair assembly 900 is not optimized for utilization by the user for sporting tasks (or any type of task, etc.), while the frame assembly 100 is configured or optimized for a sporting task. In this manner, the user of the wheelchair assembly 900 may continue to remain as physically active (as much as possible) by participating in a desired sporting activity (sporting task) in spite of the apparent physical disability of the user. The wheelchair assembly 900 (in combination with the seat assembly 901 and the first wheel assembly 905 and the second wheel assembly 907) may be utilized for everyday living and working by the user, while on the other hand the frame assembly 100 (in combination with the seat assembly 901 and the first wheel assembly 905 and the second wheel assembly 907) may be utilized for a sporting event or sporting task. It will be appreciated that any description for the first wheel assembly 905 may be applicable to the second wheel assembly 907.

The frame assembly 100 is configured to provide an option for utilizing components of the wheelchair assembly 900 so that the frame assembly 100 is utilizable for specific athletic or sporting objectives by swapping out components of the wheelchair assembly 900 for installation to the frame assembly 100 that is configured for sporting functions (events).

In accordance with an embodiment, the frame assembly 100 provides a lower cost approach for ownership for the user (in that the frame assembly 100 does not have to be bought in combination with the seat assembly 901 and the first wheel assembly 905 and the second wheel assembly 907). Alternatively, the frame assembly 100 may be sold in combination with the seat assembly 901 and the first wheel assembly 905 and the second wheel assembly 907 (if desired).

Once the user no longer wishes to utilize the frame assembly 100 (in combination with the seat assembly 901 and the first wheel assembly 905), the user disconnects the seat assembly 901 and the first wheel assembly 905 from the frame assembly 100. Then, the user may securely connect (either directly or indirectly) the seat assembly 901 and the first wheel assembly 905 and the second wheel assembly 907 back to the wheelchair assembly 900 (and it will be appreciated that the frame assembly 100 is no longer usable once the seat assembly 901 and the first wheel assembly 905 and the second wheel assembly 907 are disconnected from the frame assembly 100). It will be appreciated that the user may securely connect a portion (a frame portion) of the seat assembly 901 back to the wheelchair assembly 900.

Figure 7:
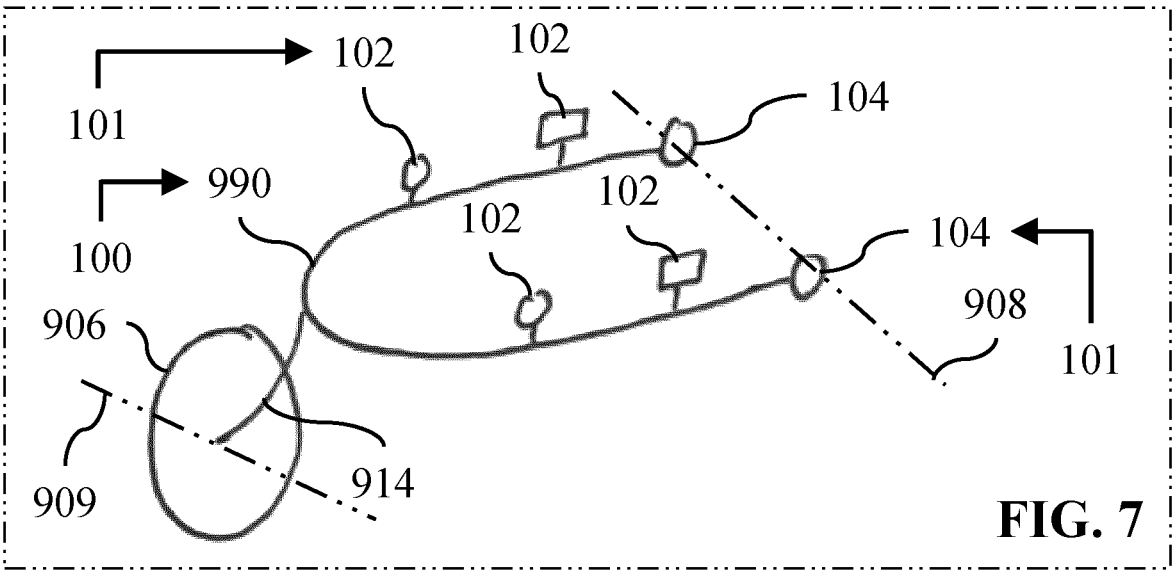
FIG. 7, FIG. 8 and FIG. 9 depict a side perspective view (FIG. 7), a side perspective view (FIG. 8) and a side perspective view (FIG. 9) of embodiments of a frame assembly configured for utilization with the embodiments of the wheelchair assembly of any one of FIG. 1 to FIG. 6.
Figure 8:
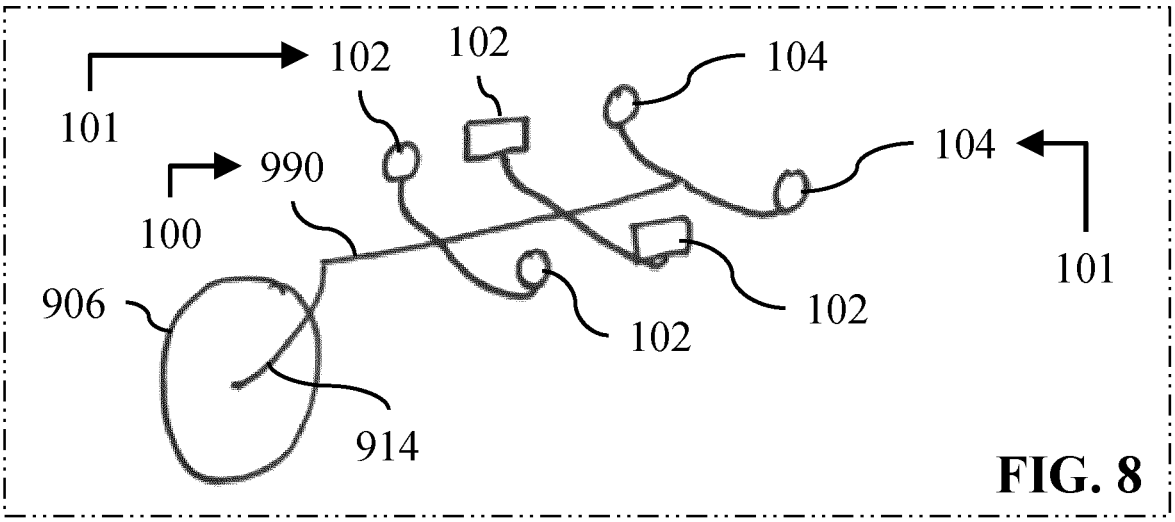
Figure 9:
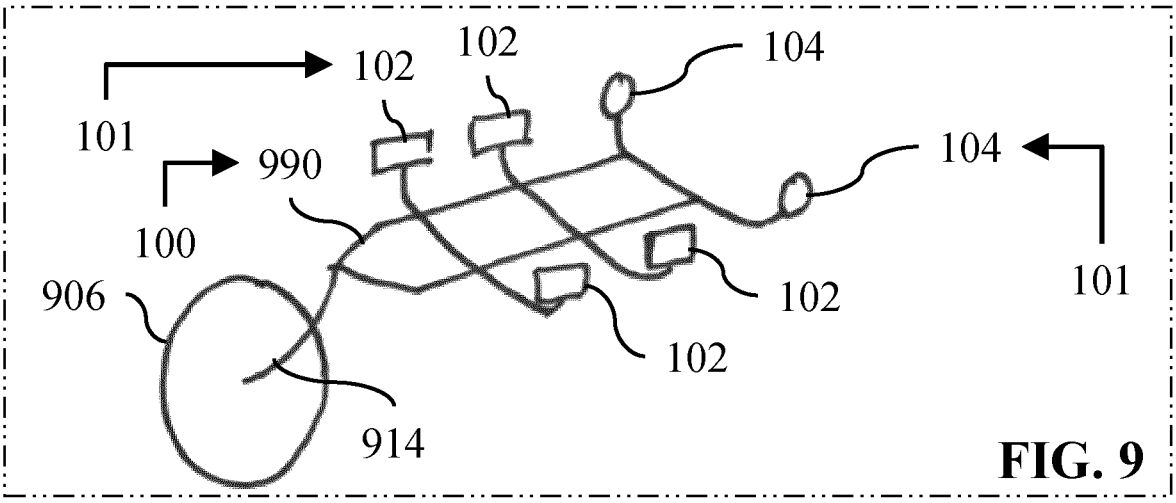

FIG. 7, FIG. 8 and FIG. 9 depict a side perspective view (FIG. 7), a side perspective view (FIG. 8) and a side perspective view (FIG. 9) of embodiments of a frame assembly 100 configured for utilization with any one or more of the embodiments of the wheelchair assembly 900 of any one of FIG. 1 to FIG. 6.

Figure 10:
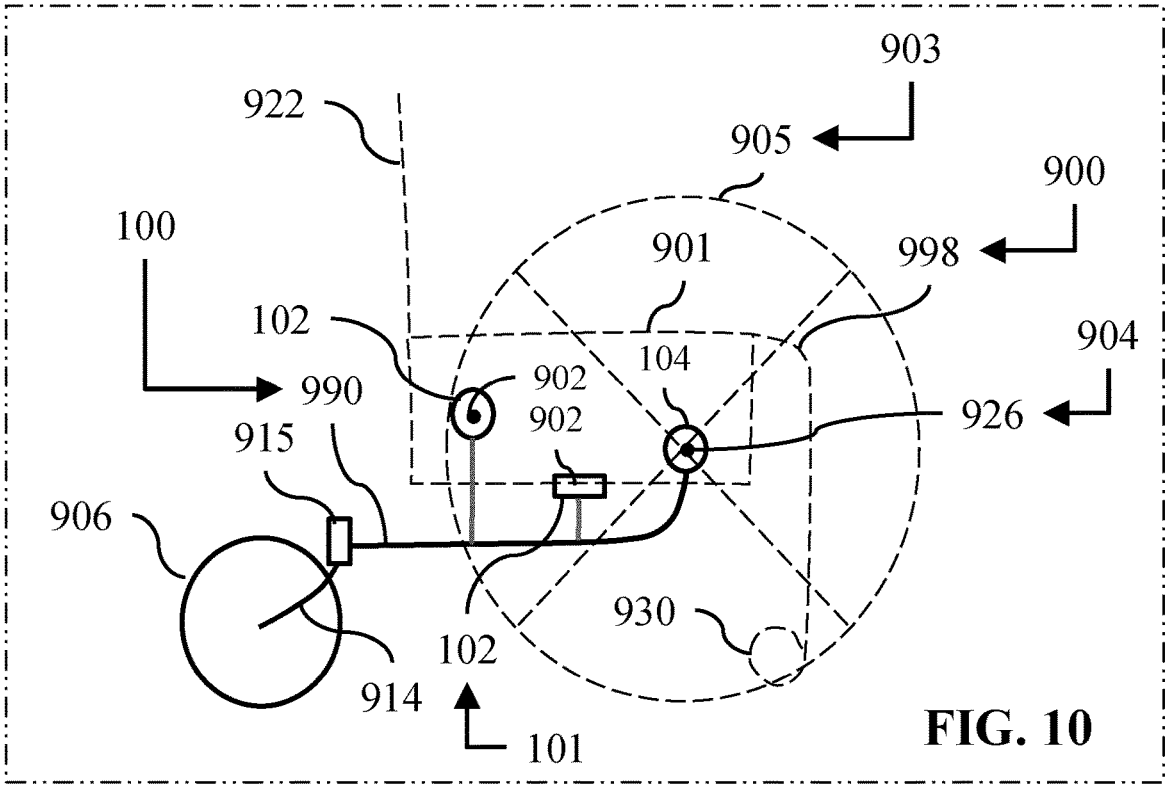
FIG. 10 depicts a side view of an embodiment of the frame assembly of any one of FIG. 7 and FIG. 8.
Figure 11:
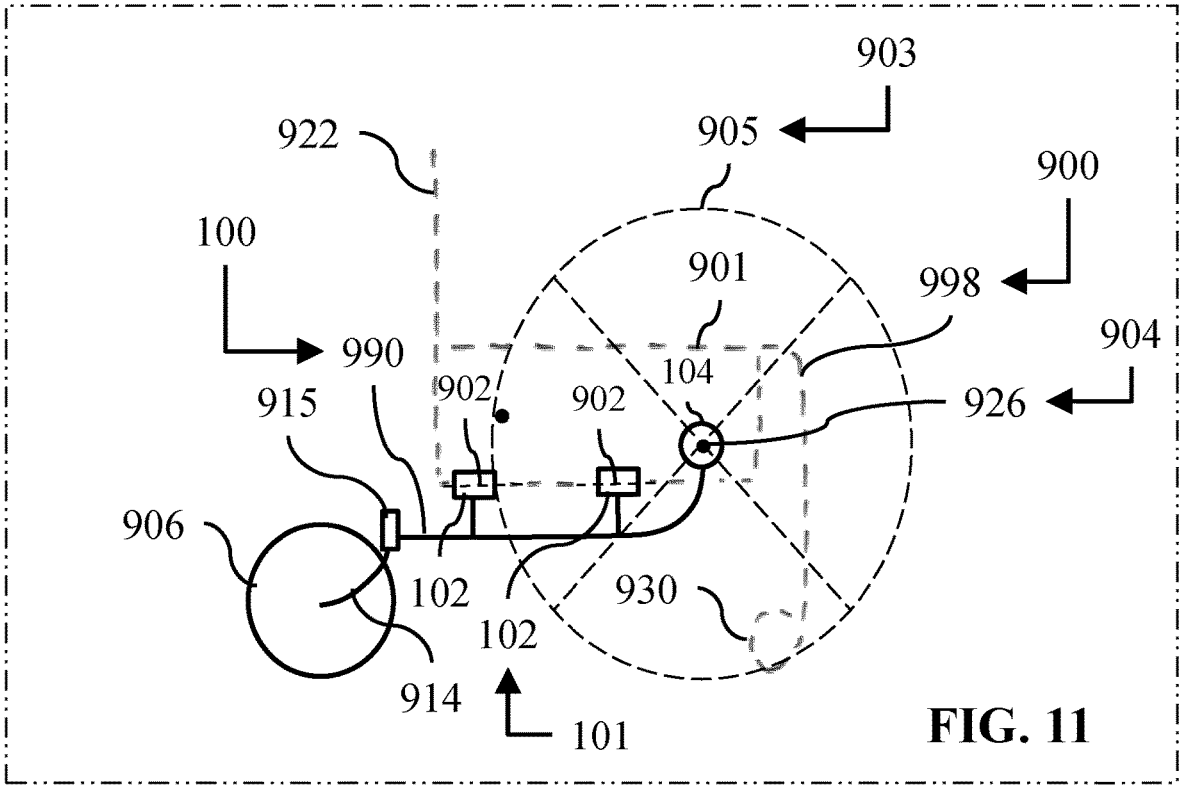
FIG. 11 depicts a side view of an embodiment of the frame assembly of FIG. 9.
Figure 12:
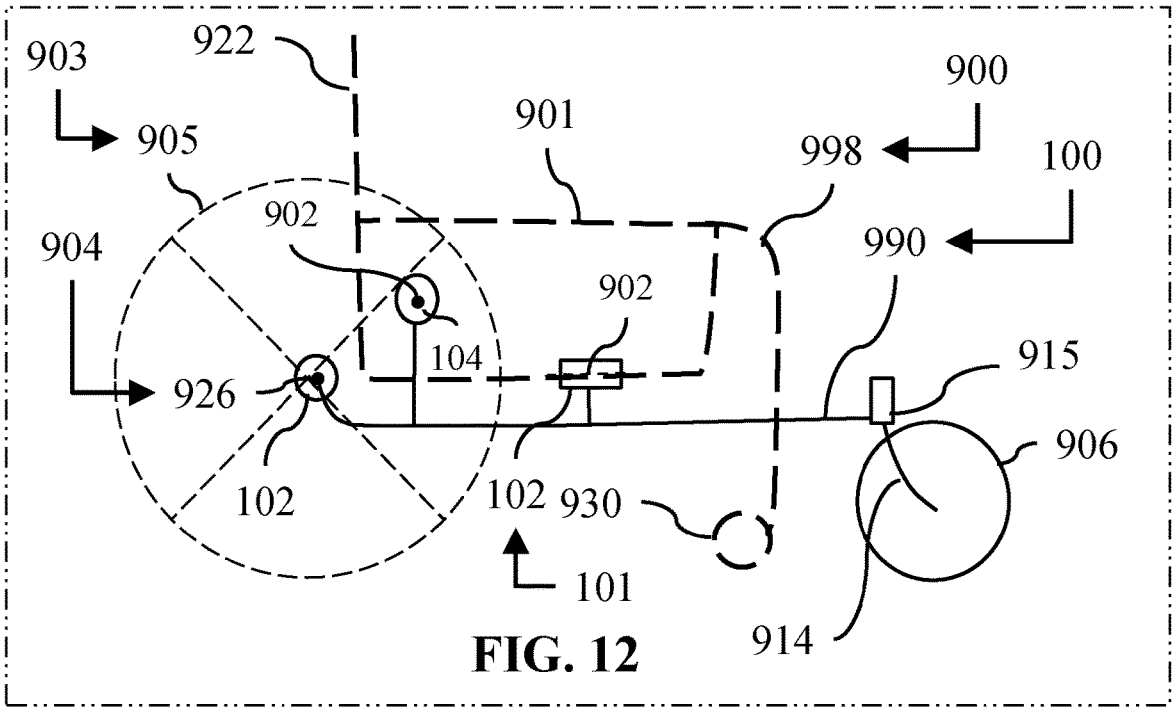
FIG. 12 depicts a side view of an embodiment of the frame assembly of any one of FIG. 7, FIG. 8 and FIG. 9.

Referring to the embodiments as depicted in any one of FIG. 7, FIG. 8 and FIG. 9, an apparatus includes and is not limited to (comprises) a frame assembly 100. The apparatus also includes spaced-apart frame connector points 101 that are fixedly attached to (and supported by and extend from) the frame assembly 100. The spaced-apart frame connector points 101 are configured to be selectively connectable with a seat assembly 901 (as depicted in the embodiments of FIG. 10, FIG. 11 and FIG. 12) and with spaced-apart wheel assemblies 903 (as depicted in the embodiments of FIG. 10, FIG. 11 and FIG. 12) of the wheelchair assembly 900. This is done once the seat assembly 901 and the spaced-apart wheel assemblies 903 are selectively disconnected and removed from the wheelchair assembly 900 (such as, selectively disconnected and removed from the wheelchair assembly 900, as depicted in the embodiment of FIG. 1).

FIG. 7 to FIG. 12 depict a square shape (or a rectangular shape) to symbolize (represent) a clamp assembly, and a circular shape (or a round shape) to symbolize an axle connector assembly (also called, a hub, an axle hub, etc.).

Referring to the embodiment of FIG. 7, the spaced-apart seat connector points 102 positioned (located) closest to the auxiliary wheel assembly 906 include (are depicted as) a circular shape (or a round shape) to symbolize an axle connector assembly. The spaced-apart seat connector points 102 positioned (located) closest to the spaced-apart wheel connector points 104 include (are depicted as) a square shape (or a rectangular shape) to symbolize (represent) a clamp assembly. The spaced-apart wheel connector points 104 include (are depicted as) a circular shape (or a round shape) to symbolize an axle connector assembly. The spaced-apart seat connector points 102 and the spaced-apart wheel connector points 104 extend (directly) from (are fixedly attached to) the elongated tubular frame member 990.

Referring to the embodiment as depicted in FIG. 8, the spaced-apart seat connector points 102 positioned (located) closest to the auxiliary wheel assembly 906 include (are depicted as) a circular shape (or a round shape) to symbolize an axle connector assembly. The spaced-apart seat connector points 102 positioned (located) closest to the spaced-apart wheel connector points 104 include (are depicted as) a square shape (or a rectangular shape) to symbolize (represent) a clamp assembly. The spaced-apart wheel connector points 104 include (are depicted as) a circular shape (or a round shape) to symbolize an axle connector assembly. The spaced-apart seat connector points 102 and the spaced-apart wheel connector points 104 extend indirectly from (are fixedly attached to) a branch frame of the elongated tubular frame member 990.

Referring to the embodiment as depicted in FIG. 9, the spaced-apart seat connector points 102 positioned (located) closest to the auxiliary wheel assembly 906 and the spaced-apart seat connector points 102 positioned closest to the spaced-apart wheel connector points 104 include (are depicted as) a square shape (or a rectangular shape) to symbolize (represent) a clamp assembly. The spaced-apart wheel connector points 104 include (are depicted as) a circular shape (or a round shape) to symbolize an axle connector assembly. Each instance of the spaced-apart seat connector points 102 and the spaced-apart wheel connector points 104 extend from (are fixedly attached to) the elongated tubular frame member 990.

Referring to the embodiment as depicted in FIG. 10, the spaced-apart seat connector points 102 positioned (located) closest to the auxiliary wheel assembly 906 include (are depicted as) a circular shape (or a round shape) to symbolize an axle connector assembly. The spaced-apart seat connector points 102 positioned (located) closest to the spaced-apart wheel connector points 104 include (are depicted as) a square shape (or a rectangular shape) to symbolize (represent) a clamp assembly. The spaced-apart wheel connector points 104 include (are depicted as) a circular shape (or a round shape) to symbolize an axle connector assembly. The spaced-apart seat connector points 102 and the spaced-apart wheel connector points 104 extend from (are fixedly attached to) the elongated tubular frame member 990.

Referring to the embodiment as depicted in FIG. 11, the spaced-apart seat connector points 102 positioned (located) closest to the auxiliary wheel assembly 906 and positioned (located) closest to the spaced-apart wheel connector points 104 include (are depicted as) a square shape (or a rectangular shape) to symbolize (represent) a clamp assembly. The spaced-apart wheel connector points 104 include (are depicted as) a circular shape (or a round shape) to symbolize an axle connector assembly. The spaced-apart seat connector points 102 and the spaced-apart wheel connector points 104 extend from (are fixedly attached to) the elongated tubular frame member 990.

Referring to the embodiments as depicted in any one of FIG. 7, FIG. 8 and FIG. 9, the spaced-apart frame connector points 101 are also configured to be selectively disconnected from the seat assembly 901 and from the spaced-apart wheel assemblies 903 of the wheelchair assembly 900. This is done so that the seat assembly 901 and the spaced-apart wheel assemblies 903 are selectively reconnectable with the wheelchair assembly 900.

Figure 13:
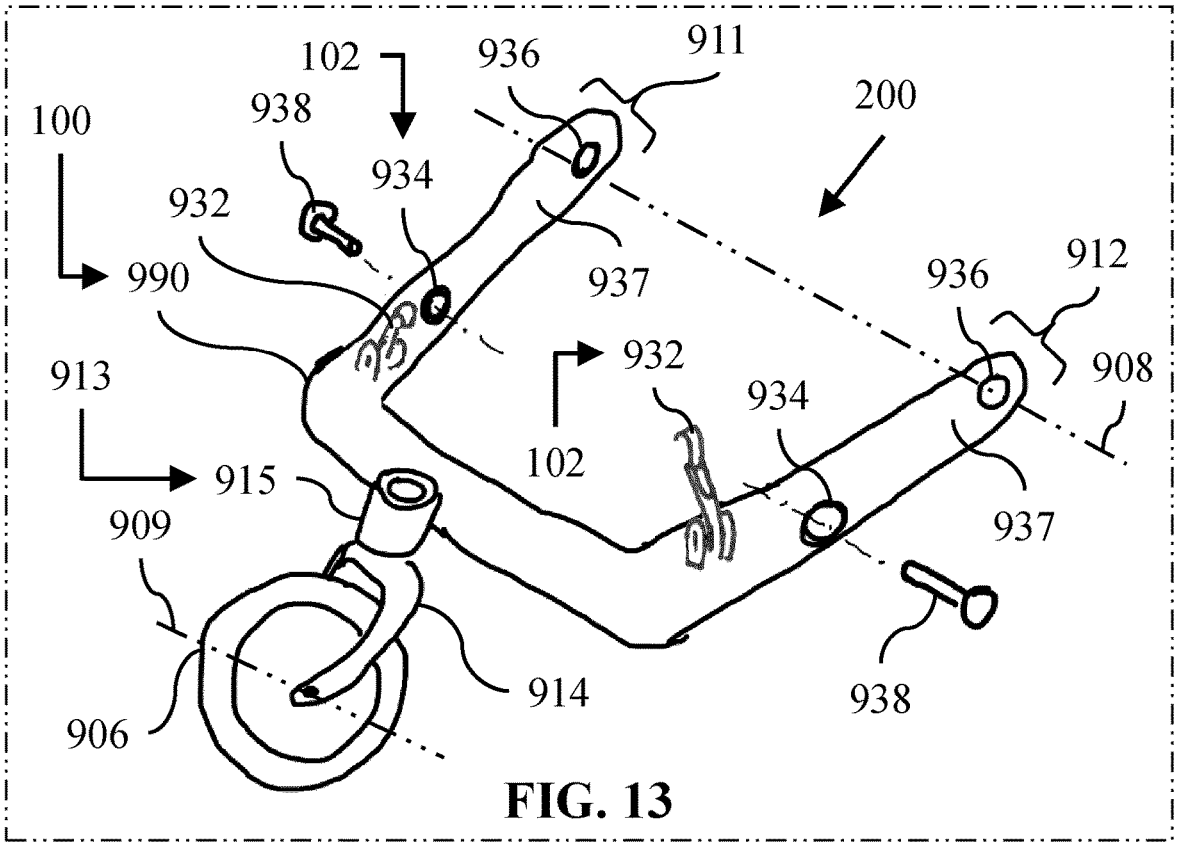
FIG. 13 depicts a rear perspective view of an embodiment of the frame assembly of any one of FIG. 7, FIG. 8 and FIG. 9.

Referring to the embodiments as depicted in any one of FIG. 7, FIG. 8 and FIG. 9, the apparatus is adapted such that the frame assembly 100 is configured to support an auxiliary wheel assembly 906 in a spaced-apart relationship relative to the spaced-apart wheel assemblies 903 (as depicted in the embodiments of FIG. 10, FIG. 11 and FIG. 12). This is done once the spaced-apart wheel assemblies 903 are selectively rotatably mounted to the frame assembly 100. An auxiliary rotation axis 909 of the auxiliary wheel assembly 906 is spaced apart from a common rotation axis 908 extending between the spaced-apart wheel assemblies 903 (as also depicted in the embodiment of FIG. 13). This is done once (A) the frame assembly 100, in use, supports the auxiliary wheel assembly 906, and (B) the spaced-apart wheel assemblies 903, in use, are selectively rotatably mounted to the frame assembly 100.

Referring to the embodiments as depicted in FIG. 10, FIG. 11 and FIG. 12, the apparatus is adapted such that the seat assembly 901 includes spaced-apart seat-connection points 902. The spaced-apart frame connector points 101 include spaced-apart seat connector points 102 fixedly attached to (and supported by and extend from) the frame assembly 100. The spaced-apart seat connector points 102 are configured to be respectively selectively connectable to (and disconnectable from) the spaced-apart seat-connection points 902 of the seat assembly 901 of the wheelchair assembly 900 (once the seat assembly 901 is selectively disconnected from the wheelchair assembly 900).

Referring to the embodiments as depicted in FIG. 10, FIG. 11 and FIG. 12, the apparatus is adapted such that the spaced-apart wheel assemblies 903 include spaced-apart wheel-connection points 904. The spaced-apart frame connector points 101 include spaced-apart wheel connector points 104 that are fixedly attached to (and supported by and extend from) the frame assembly 100. The spaced-apart wheel connector points 104 are configured to be respectively selectively rotatably connectable to (and disconnectable from) the spaced-apart wheel-connection points 904 of the spaced-apart wheel assemblies 903 (once the spaced-apart wheel assemblies 903 are selectively disconnected from the wheelchair assembly 900).

Referring to the embodiments as depicted in FIG. 7, FIG. 10, FIG. 11 and FIG. 12, the apparatus is adapted such that the spaced-apart wheel assemblies 903 are aligned coaxially and share (in use) a common rotation axis 908 once (A) the spaced-apart wheel assemblies 903 are disconnected from the wheelchair assembly 900, and (B) the spaced-apart wheel connector points 104, in use, selectively rotatably connect the frame assembly 100 to the spaced-apart wheel-connection points 904 of the spaced-apart wheel assemblies 903.

Referring to the embodiments as depicted in any one of FIG. 7, FIG. 8 and FIG. 9, an apparatus includes and is not limited to (comprises) a frame assembly 100. The frame assembly 100 is configured to be selectively connectable with a seat assembly 901 of a wheelchair assembly 900 (once the seat assembly 901 is selectively disconnected and removed from the wheelchair assembly 900, as depicted in the embodiment of FIG. 3, for instance). The frame assembly 100 is also configured to be selectively connectable with spaced-apart wheel assemblies 903 of the wheelchair assembly 900 (once the spaced-apart wheel assemblies 903, such as a first wheel assembly 905 and a second wheel assembly 907, are selectively disconnected and removed from the wheelchair assembly 900, as depicted in the embodiment of FIG. 3, for instance).

Referring to the embodiments as depicted in any one of FIG. 7, FIG. 8 and FIG. 9, the apparatus is adapted such that the frame assembly 100 is also configured to be selectively disconnected from the seat assembly 901 of the wheelchair assembly 900 so that the seat assembly 901 is selectively reconnectable with the wheelchair assembly 900 (as depicted in the embodiment of FIG. 3, for instance). In addition, the frame assembly 100 is also configured to be selectively disconnected from the spaced-apart wheel assemblies 903 of the wheelchair assembly 900 so that the spaced-apart wheel assemblies 903 are selectively reconnectable with the wheelchair assembly 900 (as depicted in the embodiment of FIG. 3, for instance).

Referring to the embodiments as depicted in any one of FIG. 7, FIG. 8 and FIG. 9, the apparatus is adapted such that the frame assembly 100 is also configured to support an auxiliary wheel assembly 906. The auxiliary wheel assembly 906 is spaced apart from the spaced-apart wheel assemblies 903 of the wheelchair assembly 900 once (A) the frame assembly 100, in use, supports the auxiliary wheel assembly 906, and (B) the spaced-apart wheel assemblies 903 are selectively rotatably mounted to the frame assembly 100.

Referring to the embodiment as depicted in FIG. 10, the frame assembly 100 has the spaced-apart wheel connector points 104 (spaced-apart links) configured to host the spaced-apart wheel assemblies 903. The frame assembly 100 also has the spaced-apart seat connector points 102 (a set of links) configured to connect the frame assembly 100 to the seat assembly 901 of the wheelchair assembly 900 (such as, to the seat frame 998 of the wheelchair assembly 900). The frame assembly 100 is configured to selectively connect to the frame of the seat assembly 901, and the frame assembly 100 is also configured to selectively connect with (the axle hubs) of the spaced-apart wheel assemblies 903 of the wheelchair assembly 900. The auxiliary wheel assembly 906 is positioned behind the seat assembly 901 with the spaced-apart wheel assemblies 903 positioned toward the frontal part (portion) of the seat assembly 901.

Referring to the embodiment as depicted in FIG. 11, the spaced-apart seat connector points 102 (links) are configured to selectively securely couple with the seat frame 998 (tubular part of the frame), and not with the axle hubs of the spaced-apart wheel assemblies 903. The auxiliary wheel assembly 906 is positioned behind the seat assembly 901 with the spaced-apart wheel assemblies 903 positioned in front of the seat assembly 901.

Referring to the embodiment as depicted in FIG. 12, the auxiliary wheel assembly 906 is positioned in front of the seat assembly 901 with the spaced-apart wheel assemblies 903 positioned behind the seat assembly 901.

In accordance with the embodiments as depicted in FIG. 7 to FIG. 12, there is provided a geometry-converting suspension and drive system for the wheelchair assembly 900 (also called a manual wheelchair, etc.). The suspension and drive control mechanism is configured to be selectively connected to selected components of the wheelchair assembly 900 (such as, the known manual wheelchair) used by physically disabled occupants (once those components are selectively disconnected from the wheelchair assembly 900). The frame assembly 100 is configured to allow for converting the configuration and geometry of the wheelchair assembly 900 (such as, a traditional four wheel configuration wheelchair).

In accordance with an option, the spaced-apart wheel assemblies 903 (also called the main weight supporting wheels) are positioned behind the center of gravity with the spaced-apart caster wheels 930 (also called the small front caster wheels), so that the frame assembly 100 forms (provides) a trike configuration. In the trike configuration, the spaced-apart wheel assemblies 903 (also called main weight supporting wheels) are positioned in front of the center of gravity with the auxiliary wheel assembly 906 (such as, and not limited to, a dragger wheel). The auxiliary wheel assembly 906 is also weight supporting, and is positioned (such as) behind the centre of gravity. By converting the geometry, the arrangement may achieve improved stability and controllability over diverse surfaces and terrain conditions, including but not limited to soft and rough surfaces, obstacles, steeper slopes, and dynamically varying acceleration (in both increasing and decreasing speeds). The frame assembly 100 (also called a geometry converting system) may be utilized for both purely manual propulsion as well as for power assisted propulsion. The frame assembly 100 may provide a common mechanical interface mechanism for easy mounting and dismounting on most traditional (known or existing) wheelchairs. The frame assembly 100 may improve stability of the wheelchair when operated at a higher speed. The frame assembly 100 may improve stability and terrain negotiating capabilities of the wheelchair when operated over rough, soft or uneven surfaces. The frame assembly 100 may improve stability of the wheelchair when scaling obstacles. The frame assembly 100 may provide the ability to use (convert) the wheelchair assembly 900 in the stable trike mode in places where (for example) a small footprint may be required, etc.

In accordance with the embodiments as depicted in FIG. 7 to FIG. 12, the frame assembly 100 includes the auxiliary wheel assembly 906 (also called, and not limited to, a free-swivel wheel, etc.). The frame assembly 100 is configured to be installed by the user by removing the spaced-apart wheel assemblies 903 (also called the main supporting wheels) from the wheelchair assembly 900 (as depicted in the embodiments of FIG. 1 to FIG. 6), and attaching the frame assembly 100 to (the hub of) the seat assembly 901, and then attaching the seat assembly 901 (the main supporting wheels) to the front hubs of the frame assembly 100. The frame assembly 100 can be uninstalled by detaching the frame assembly 100 from (the hub of) the seat assembly 901, and reattaching the spaced-apart seat-connection points 902 back to the axle hubs of the wheelchair assembly 900.

FIG. 10, FIG. 11, and FIG. 12 depict side views of embodiments of the frame assembly 100 of any one of FIG. 7, FIG. 8 and FIG. 9.

Referring to the embodiments as depicted in FIG. 10 and FIG. 11, the apparatus is adapted such that the seat assembly 901, in use, faces toward the first wheel assembly 905 and the second wheel assembly 907 once the spaced-apart seat connector points 102 (or the seat-connector assembly 932 as depicted in FIG. 13, for instance), in use, selectively connects the elongated tubular frame member 990 (which is an example of the frame assembly 100) and the seat assembly 901 with each other.

Referring to the embodiment as depicted in FIG. 12, the apparatus is adapted such that the seat assembly 901, in use, faces away from the first wheel assembly 905 and the second wheel assembly 907 once the spaced-apart seat connector points 102 (such as, the seat-connector assembly 932 of FIG. 13, for instance), in use, selectively connects the elongated tubular frame member 990 and the seat assembly 901 with each other.

FIG. 13 depicts a rear perspective view of an embodiment of the frame assembly 100 of any one of FIG. 7, FIG. 8 and FIG. 9.

Figure 14:
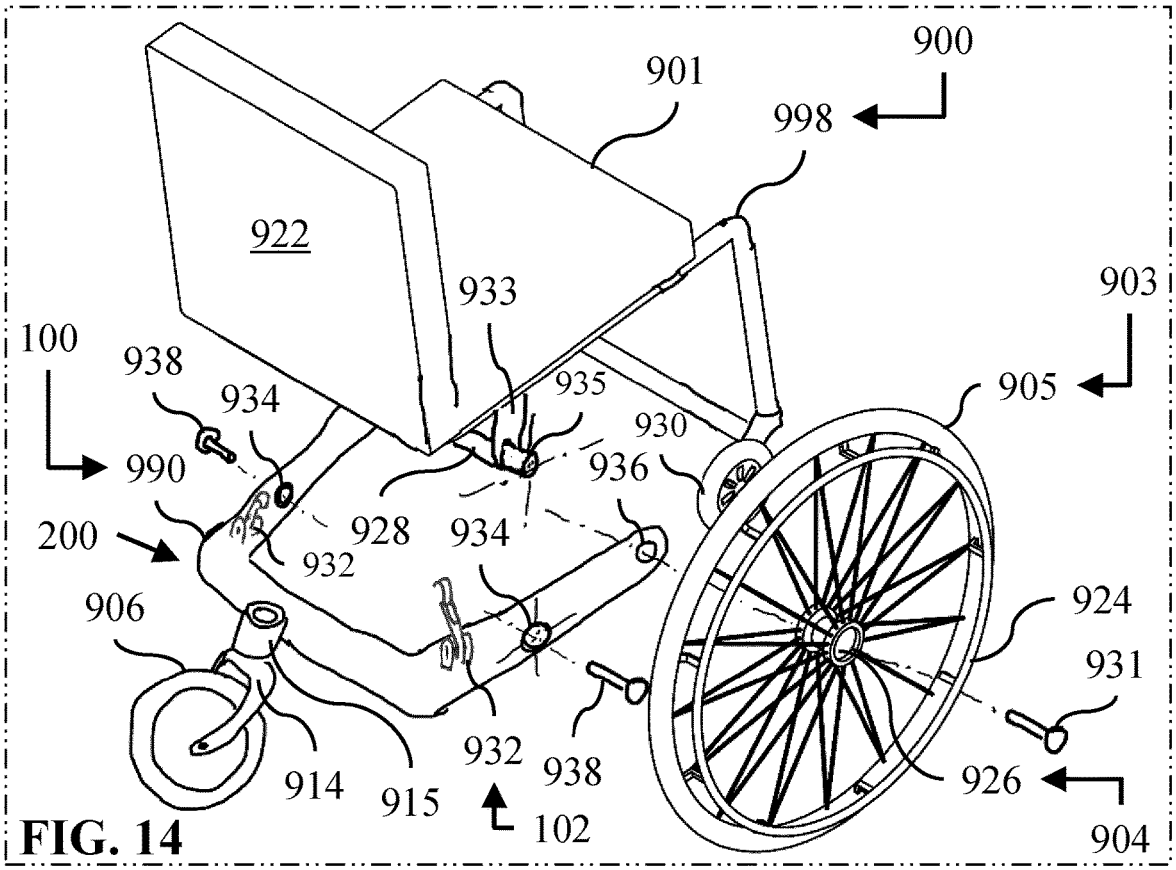
FIG. 14 depicts a rear exploded perspective view of an embodiment of the frame assembly of any one of FIG. 7, FIG. 8 and FIG. 9.

FIG. 14 depicts a rear exploded perspective view of an embodiment of the frame assembly 100 of any one of FIG. 7, FIG. 8 and FIG. 9.

Referring to the embodiment as depicted in FIG. 13, the apparatus is adapted such that the frame assembly 100 includes a pair of spaced-apart prongs 937. The spaced-apart wheel assemblies 903 (with a relatively larger radius) are mountable to the pair of spaced-apart prongs 937 of the frame assembly 100 so that the auxiliary wheel assembly 906 (rear wheel) and a centre of gravity are located behind the spaced-apart wheel assemblies 903 (opposite the front wheels).

Referring to the embodiment as depicted in FIG. 13, the apparatus is adapted such that the frame assembly 100 includes a (substantially flattened or planar) U-shaped frame 200. The U-shaped frame 200 is configured to securely support an auxiliary wheel assembly 906 (the auxiliary wheel assembly 906 is mountable to a rear (central) portion of the U-shaped frame 200). The spaced-apart wheel assemblies 903 are coaxially mountable to a frontal portion (frontal prongs) of the U-shaped frame 200, and the spaced-apart wheel assemblies 903 share (in use) a common rotation axis 908 that extends through the frontal portion (frontal prongs) of the U-shaped frame 200.

Referring to the embodiment as depicted in FIG. 14, an apparatus includes and is not limited to (comprises) a frame assembly 100. The frame assembly 100 is configured for utilization with components of a wheelchair assembly 900 (as depicted in the embodiments of any one of FIG. 1 to FIG. 6). The wheelchair assembly 900 includes a first wheel assembly 905 and a second wheel assembly 907. The first wheel assembly 905 and the second wheel assembly 907 are configured to be selectively disconnectable from the wheelchair assembly 900. The wheelchair assembly 900 includes a seat assembly 901 configured to be selectively disconnectable from the wheelchair assembly 900.

The frame assembly 100 includes (and is not limited to) an elongated tubular frame member 990.

The frame assembly 100 also includes a first wheel mount 911 (also called the first elongated prong tubular member) extending from the elongated tubular frame member 990. The first wheel mount 911 is configured to securely rotatably receive and support the first wheel assembly 905 of the wheelchair assembly 900 once the first wheel assembly 905 is selectively disconnected from the wheelchair assembly 900.

The frame assembly 100 also includes a second wheel mount 912 (also called a second elongated prong tubular member) extending from the elongated tubular frame member 990. The second wheel mount 912 is configured to securely rotatably receive and support the second wheel assembly 907 of the wheelchair assembly 900 once the second wheel assembly 907 is disconnected from the wheelchair assembly 900. The second wheel mount 912 and the first wheel mount 911 are spaced apart from each other.

The frame assembly 100 also includes a third wheel tubular mount 913 extending from the elongated tubular frame member 990. The third wheel tubular mount 913 is configured to securely rotatably receive and support the auxiliary wheel assembly 906 at a spaced-apart relationship relative to the first wheel assembly 905 and the second wheel assembly 907 of the wheelchair assembly 900.

Referring to the embodiment as depicted in FIG. 14, the apparatus is adapted such that the first wheel assembly 905 and the second wheel assembly 907 are spaced apart from each other once (A) the first wheel assembly 905 is rotatably mounted to the first wheel mount 911, and (B) the second wheel assembly 907 is rotatably mounted to the second wheel mount 912.

Referring to the embodiment as depicted in FIG. 13, the apparatus is adapted such that the first wheel assembly 905 and the second wheel assembly 907 are coaxially aligned with each other so that a rotation axis extends between the first wheel assembly 905 and the second wheel assembly 907 once (A) the first wheel mount 911, in use, rotatably supports the first wheel assembly 905, and (B) the second wheel mount 912, in use, rotatably supports the second wheel assembly 907.

Referring to the embodiment as depicted in FIG. 13, the apparatus is adapted such that the auxiliary wheel assembly 906 is rotatable along an auxiliary rotation axis 909 extending between the first wheel assembly 905 and the second wheel assembly 907 once (A) the first wheel mount 911, in use, rotatably supports the first wheel assembly 905, and (B) the second wheel mount 912, in use, rotatably supports the second wheel assembly 907, and (C) the third wheel tubular mount 913, in use, receives and supports the auxiliary wheel assembly 906.

Referring to the embodiment as depicted in FIG. 13, the apparatus is adapted such that the elongated tubular frame member 990 is configured to locate (position) and support the seat assembly 901 between the auxiliary wheel assembly 906 and a common rotation axis 908 extending through the first wheel assembly 905 and the second wheel assembly 907.

Referring to the embodiment as depicted in FIG. 13, the apparatus is adapted such that the elongated tubular frame member 990 is configured to locate (position) and support the seat assembly 901 between the auxiliary wheel assembly 906 and a common rotation axis 908 extending through the first wheel assembly 905 and the second wheel assembly 907.

Referring to the embodiment as depicted in FIG. 13, the apparatus further includes the seat-connector assembly 932 configured to selectively connect the elongated tubular frame member 990 and the seat assembly 901 with each other. The seat-connector assembly 932 is also configured to selectively disconnect the elongated tubular frame member 990 and the seat assembly 901 from each other.

In accordance with the embodiments as depicted in FIG. 13, the frame assembly 100 (also called a console frame body or a beam, etc., and any equivalent thereof) having spaced-apart front axle hubs 936 also called front axle hubs, which are an example of the spaced-apart wheel connector points 104, as depicted in the embodiment of FIG. 7. The spaced-apart front axle hubs 936 are configured to host (selectively receive and support) the spaced-apart wheel-connection points 904 in a trike configuration.

In accordance with the embodiments as depicted in FIG. 13, the frame assembly 100 also includes the spaced-apart seat connector points 102, and the spaced-apart seat connector points 102 includes (more specifically) spaced-apart axle connector assemblies 934 (also called rear axle hubs) configured to mount on (selectively connect to) the seat assembly 901 (that is, configured to mount to the seat hub 935 of the seat assembly 901, as depicted in the embodiment of FIG. 14).

In accordance with the embodiments as depicted in FIG. 13, the frame assembly 100 also includes the seat-connector assembly 932 (also called an adjustable locking strut support, which is an example of the spaced-apart seat connector points 102, as depicted in the embodiment of FIG. 7). The seat-connector assembly 932 is positioned (situated) appropriately on the frame assembly 100. The seat-connector assembly 932 is configured be selectively attached to the seat frame 998 (also called the tubular structure) of the seat assembly 901. The seat-connector assembly 932 is configured to selectively affix the seat frame 998 of the wheelchair assembly 900 to the frame assembly 100. This is done in such a way that the spaced-apart caster wheels 930 (front caster wheels) are lifted and do not have contact with the supporting surface (the ground).

In accordance with the embodiments as depicted in FIG. 13, the frame assembly 100 also includes the swivel fork 914 (also called a swiveling wheel fork). The auxiliary wheel assembly 906 (also called, and not limited to, a free rotating caster wheel, which is a weight-supporting wheel) is rotatably mounted to the swivel fork 914. Preferably, the auxiliary wheel assembly 906, in use, provides support behind the center of gravity in a trike mode.

In accordance with the embodiments as depicted in FIG. 13, the frame assembly 100 is configured to be secured to the wheel hub 926 (also called the main axle hubs) of the spaced-apart wheel assemblies 903 by the wheel connectors 931 (also called push-pull pins that are commonly used for attaching the spaced-apart wheel assemblies 903 to the wheelchair assembly 900).

In accordance with the embodiments as depicted in FIG. 14, the frame assembly 100 is also configured to be selectively secured to the seat frame 998 (tubular structure) of the wheelchair assembly 900 via the seat-connector assembly 932 (also called strut supports). This is done in such a way that the frame assembly 100 is firmly affixed at a constant angle of orientation to the seat frame 998 of the wheelchair assembly 900. The seat-connector assembly 932 (also called locking strut supports) are affixed to the frame assembly 100 through a clamp bracket (reference is made to FIG. 17, for instance).

In accordance with the embodiments as depicted in FIG. 14, the frame assembly 100 is aligned and extends around and behind the seat assembly 901. This is done in such a way that, preferably, the spaced-apart front axle hubs 936 (front axle hubs) are positioned in front of the center of gravity, and the auxiliary wheel assembly 906 (such as, and not limited to, a dragger wheel, etc.) is positioned behind the center of gravity. For the case where the spaced-apart wheel assemblies 903 are selectively attached to the spaced-apart front axle hubs 936 (front axle hubs of the frame assembly 100), the weight of the occupant (user) is distributed over the spaced-apart wheel assemblies 903 at the front and the auxiliary wheel assembly 906 positioned at the rear, and all three wheels support the user's weight.

In accordance with the embodiments as depicted in FIG. 13, the frame assembly 100 includes the auxiliary wheel assembly 906 (such as, and not limited to, a dragger wheel). A swivel fork 914 is rotatably connected to the auxiliary wheel assembly 906. A fork hub 915 is firmly attached to the frame assembly 100 (such as the elongated tubular frame member 990), and the fork hub 915 supports the swivel fork 914.

In accordance with the embodiments as depicted in FIG. 13, the seat-connector assembly 932 (also called a locking support strut, which is an example of the spaced-apart seat connector points 102, as depicted in the embodiments of FIG. 9 to FIG. 12) is configured to selectively connect the frame assembly 100 to the seat assembly 901. The spaced-apart axle connector assemblies 934 (which are an example of the spaced-apart seat connector points 102 as depicted in the embodiments of FIG. 9 to FIG. 12) are configured to selectively connect the frame assembly 100 to the seat assembly 901.

In accordance with the embodiments as depicted in FIG. 13, the spaced-apart front axle hubs 936 (which are an example of the spaced-apart wheel connector points 104, as depicted in the embodiments of FIG. 9 to FIG. 12) are configured to selectively connect the frame assembly 100 to the spaced-apart wheel assemblies 903. The seat connectors 938 (also called quick-release pins) are configured to selectively connect the elongated tubular frame member 990 to the seat hub 935.

Referring to the embodiment as depicted in FIG. 14, the seat connectors 938 are configured to selectively attach the spaced-apart axle connector assemblies 934 of the frame assembly 100 (also called the elongated tubular frame member 990) to the seat hub 935 at the end of the seat axle 928 (also called the main axle) of the seat assembly 901.

Referring to the embodiment as depicted in FIG. 14, the seat strut 933 of the seat assembly 901 is configured to attach the seat axle 928 of the seat assembly 901 to the seat frame 998 of the seat assembly 901.

Referring to the embodiment as depicted in FIG. 14, the spaced-apart wheel assemblies 903 are attached with wheel connectors 931 (such as quick-release pins) to the spaced-apart front axle hubs 936 (of the frame assembly 100) through the wheel hubs 926.

Referring to the embodiment as depicted in FIG. 14, the seat-connector assembly 932 is configured to attach the frame assembly 100 (the elongated tubular frame member 990) to the seat frame 998 of the seat assembly 901 of the wheelchair assembly 900 in such a way that the seat frame 998 and the frame assembly 100 (the elongated tubular frame member 990) are firmly affixed to (with) each other, and there is no inadvertent rotation of the seat assembly 901 around the spaced-apart axle connector assemblies 934 of the frame assembly 100.

Referring to the embodiment as depicted in FIG. 14, the auxiliary wheel assembly 906 (such as, and not limited to, a dragger wheel) is attached to the swivel fork 914, which is attached to the frame assembly 100 (the elongated tubular frame member 990) through the fork hub 915.

Figure 15:
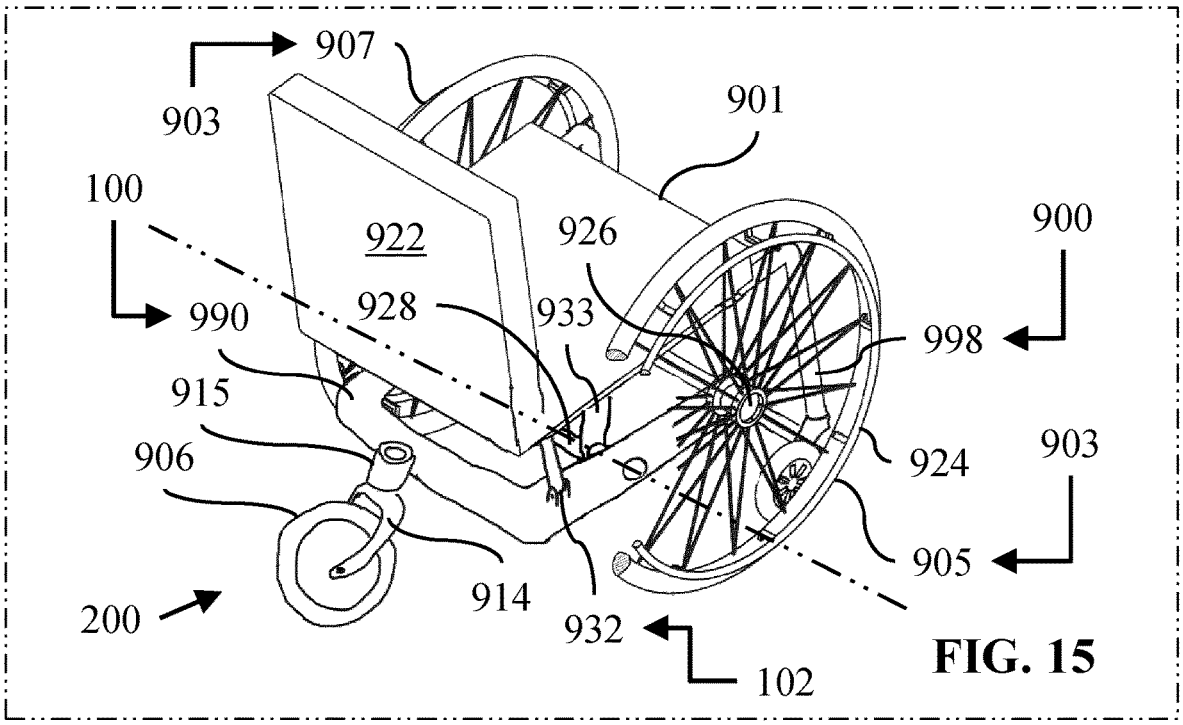
FIG. 15 depicts a rear perspective view of an embodiment of the frame assembly of any one of FIG. 7, FIG. 8 and FIG. 9 utilized with the embodiment of the wheelchair assembly of FIG. 1.

FIG. 15 depicts a rear perspective view of an embodiment of the frame assembly 100 of any one of FIG. 7, FIG. 8 and FIG. 9 utilized with the embodiment of the wheelchair assembly 900 of FIG. 1.

Referring to the embodiment as depicted in FIG. 15, the frame assembly 100 is selectively installed to the various assemblies of the wheelchair assembly 900, for example the frame assembly 100 is attachable to the seat axle 928 (the main axle) through the spaced-apart axle connector assemblies 934.

Referring to the embodiment as depicted in FIG. 15, the spaced-apart wheel assemblies 903 are positioned at the spaced-apart front axle hubs 936 of the frame assembly 100 so that the frame assembly 100 in combination with the seat assembly 901 and the spaced-apart wheel assemblies 903 (of the wheelchair assembly 900) forms a trike configuration (the components of the wheelchair assembly 900 is now configured for conversion into a trike arrangement or mode).

Referring to the embodiment as depicted in FIG. 15, the frame assembly 100 (such as the elongated tubular frame member 990) is configured to be selectively attachable to, and detachable from, the seat axle 928 (also called a main axle) through the spaced-apart axle connector assemblies 934 of the seat assembly 901.

Referring to the embodiment as depicted in FIG. 15, the seat-connector assembly 932 is configured to affix the frame assembly 100 (the elongated tubular frame member 990) to the seat frame 998 of the seat assembly 901 of the wheelchair assembly 900.

Referring to the embodiment as depicted in FIG. 15, the auxiliary wheel assembly 906 (such as, and not limited to, dragger wheel) is configured to be rotatably attached to the swivel fork 914. The swivel fork 914 is rotatably attached to the frame assembly 100 (such as the elongated tubular frame member 990) through the fork hub 915.

Referring to the embodiment as depicted in FIG. 15, the spaced-apart wheel assemblies 903 (the first wheel assembly 905, and the second wheel assembly 907) are attached to the frame assembly 100 (elongated tubular frame member 990) at the wheel hub 926 (through the wheel hub 926).

Figure 16:
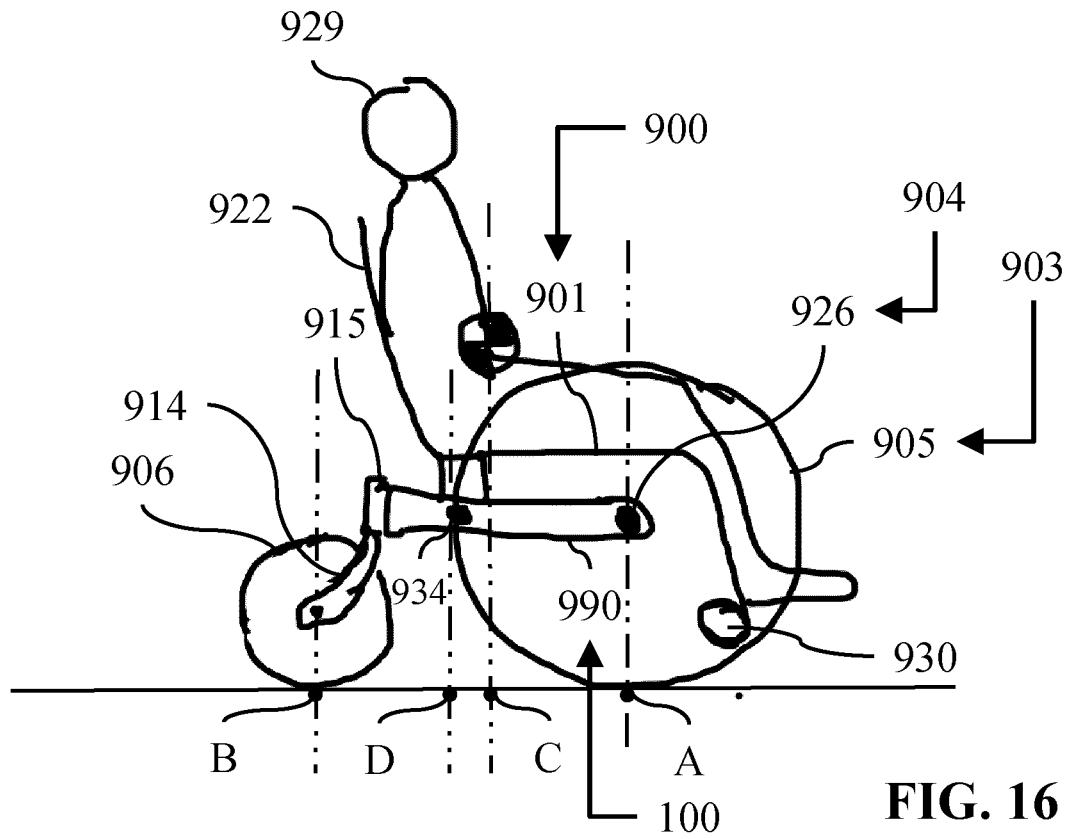
FIG. 16 depicts a side view of an embodiment of the frame assembly of any one of FIG. 7, FIG. 8 and FIG. 9.

FIG. 16 depicts a side view of an embodiment of the frame assembly 100 of any one of FIG. 7, FIG. 8 and FIG. 9.

Referring to the embodiment as depicted in FIG. 16, the longitudinal projection of the center of gravity of the combination of the seat assembly 901, the spaced-apart wheel assemblies 903 and the user 929 falls (is located) between the point of contact of the spaced-apart wheel assemblies 903 with the ground (supporting surface) and the point of contact of the auxiliary wheel assembly 906 with the supporting surface (working surface or ground).

Referring to the embodiment as depicted in FIG. 16, there is depicted the placement of the center of gravity and the supporting points of the frame assembly 100 for the case where a user 929 is sitting in the seat assembly 901. Point A depicts the point of contact of the spaced-apart wheel assemblies 903 with the supporting surface (working surface or the ground). Point B depicts the point of contact of the auxiliary wheel assembly 906 with the supporting surface. Point C depicts the projection of the center of gravity of the user 929 and the seat assembly 901 over the supporting surface. Point D depicts the projection of the center of the spaced-apart axle connector assemblies 934 over the supporting surface. Point C is located between point A and point B, and therefore the frame assembly 100 provides adequate stability and an adequate range for shifting the center of gravity without compromising the safety of the user 929.

Referring to the embodiment as depicted in FIG. 16, an apparatus includes and is not limited to (comprises) an apparatus including and not limited to (comprising) an elongated tubular frame member 990 configured to transition a wheelchair assembly 900 from a four-wheel configuration to a three-wheel configuration by utilizing the main supporting axle hubs of a wheelchair assembly 900 for a weight-supporting joint, and providing spaced-apart front axle hubs 936 for the spaced-apart wheel assemblies 903 to be attached in front of the center of gravity, and effectively transforming the spaced-apart wheel assemblies 903 of the wheelchair assembly 900 from rear wheels to front wheels by shifting the axle of the wheels across the lateral line of the center of gravity, and in which the elongated tubular frame member 990 integrates a rear support behind the center of gravity in the form of a weight supporting wheel.

Referring to the embodiment as depicted in FIG. 16, the apparatus is adapted such that the auxiliary wheel assembly 906 is positioned behind the projection of the center of gravity when the spaced-apart wheel assemblies 903 are moved into a position in front of the projection of the center of gravity. The auxiliary wheel assembly 906 is free swiveling and free rotating, preferably without a motor.

Figure 17:
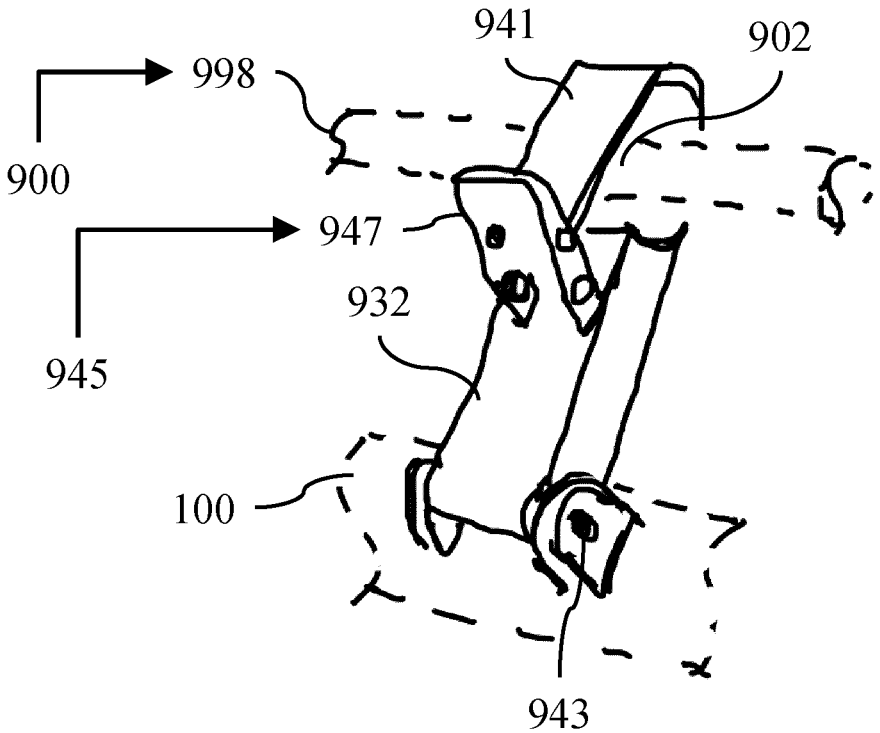
FIG. 17 depicts a side perspective view of an embodiment of the frame assembly of any one of FIG. 7, FIG. 8 and FIG. 9.

FIG. 17 depicts a side perspective view of an embodiment of the frame assembly 100 of any one of FIG. 7, FIG. 8 and FIG. 9.

Referring to the embodiment as depicted in FIG. 17, the frame assembly 100 includes the seat-connector assembly 932 (also called a support strut). The seat-connector assembly 932 is configured to be attachable to the frame assembly 100 through a hinge 943. The seat-connector assembly 932 includes (is equipped with) a clamp assembly 945 (a quick-release clamp) including a tightening handle 947 and a tightening hook 941, which when retracted, the clamp assembly 945 is positioned around the seat frame 998 of the seat assembly 901.

Figure 18:
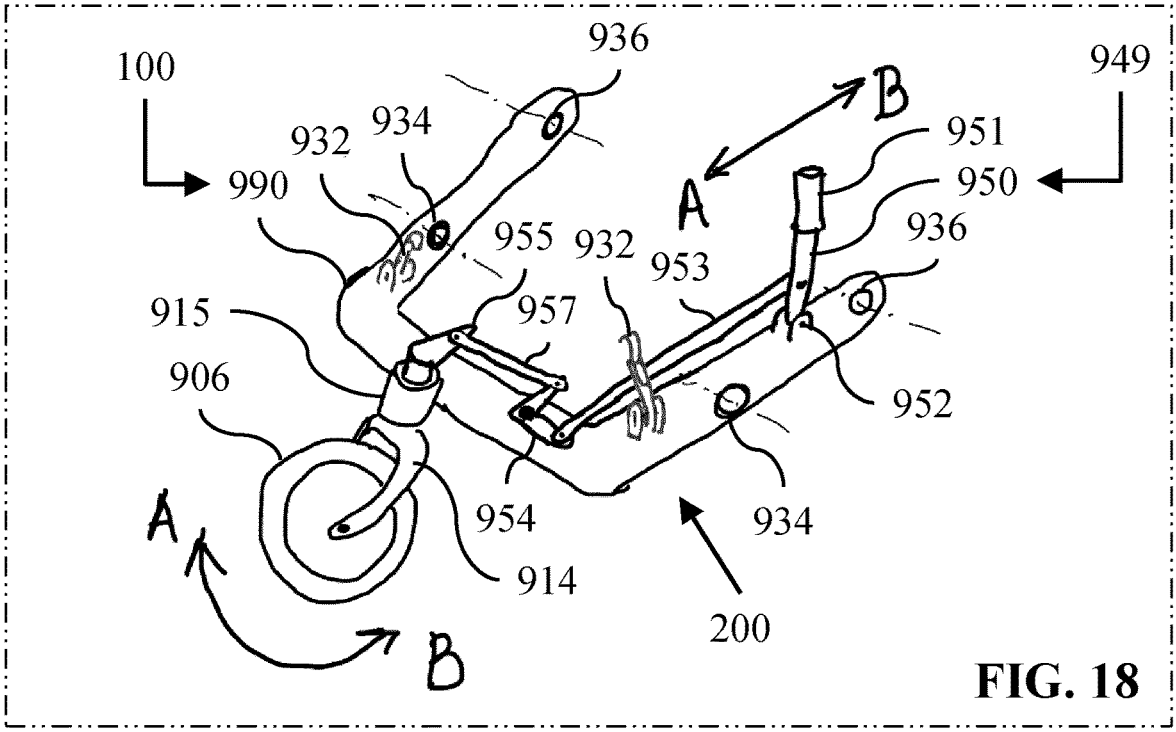
FIG. 18 depicts a side perspective view of an embodiment of the frame assembly of any one of FIG. 7, FIG. 8 and FIG. 9.

FIG. 18 depicts a side perspective view of an embodiment of the frame assembly 100 of any one of FIG. 7, FIG. 8 and FIG. 9.

Referring to the embodiment as depicted in FIG. 18, the frame assembly 100 further includes a steering control assembly 949. The steering control assembly 949 includes a control device 950 which is attached to the frame assembly 100 through a pin assembly 952, a handle 951, and a connecting rod 953 configured to transfer a controlling force to a lever 954. The lever 954 is configured to transform (change) the direction of the motion to an angle (such as, a 90 degree angle). A connection rod 957 is configured to transfer the controlling force to the control arm 955 which is firmly affixed to the swivel fork 914 and the auxiliary wheel assembly 906 (such as, and not limited to, a dragger wheel). It will be appreciated that any suitable control mechanism may be utilized, in which the control mechanism (assembly) is configured to transfer a control force from a control device (a control stick) to a wheel.

Referring to the embodiment as depicted in FIG. 18, the frame assembly 100 is further configured to support (accommodate) a steering control assembly 949, in which the steering control assembly 949 is configured to be movable forward and rearward relative to the seat assembly 901, and in which the steering control assembly 949 is also configured to steer (turn) the spaced-apart wheel assemblies 903 left and right. A technical advantage for this option is that for the case where there is limited space sideways between the user (person) and the spaced-apart wheel assemblies 903, the space located back and forth (within a relatively thin plane between the user and the spaced-apart wheel assemblies 903) becomes less limited and thus gives better options for control for the user of the frame assembly 100.

Referring to the embodiment as depicted in FIG. 18, for the case where the control device 950 is deflected backwards to position A, the steering control assembly 949, in use, transfers the motion in such a way that the auxiliary wheel assembly 906 is steered to position.

Referring to the embodiment as depicted in FIG. 18, for the case where the control device 950 is deflected backwards to position B, the steering control assembly 949, in use, transfers the motion in such a way that the auxiliary wheel assembly 906 is steered to position.

Referring to the embodiment as depicted in FIG. 18, the steering control assembly 949 is configured to transfer motion in the longitudinal plane of the wheelchair assembly 900 to a steering motion of a weight supporting rear steering wheel.

Referring to the embodiment as depicted in FIG. 18, the frame assembly 100 includes a control device 950 configured to allow the user to apply steering control. The control arm 955 (also called a control rod system) is configured to transfer steering control from the control device 950 to the auxiliary wheel assembly 906. The auxiliary wheel assembly 906 is operatively attached to the control arm 955.

Referring to the embodiment as depicted in FIG. 18, the frame assembly 100 includes a control mechanism having the control device 950 configured to rotate in a lateral plane parallel to the general direction of the movement of the frame assembly 100. A system of control rods and levers are configured to transfer the steering control force to the auxiliary wheel assembly 906 (the steering wheel). A control arm 955 is attached to the swivel fork 914, and is configured to transfer steering power (directly) to the swivel fork 914. Preferably, the swivel fork 914 is configured to rotate to a steering angle in such a way to ensure minimal turning radius of the frame assembly 100 (when operated in trike mode).

Referring to the embodiment as depicted in FIG. 18, for the case where the occupant of the frame assembly 100 wants to control the frame assembly 100 through the use of the control device 950, the occupant applies a force to the control device 950 which causes the control device 950 to rotate and act as a lever actuating the push-rod controls, which transfers the rotational motion to the auxiliary wheel assembly 906.

Referring to the embodiment as depicted in FIG. 16 and FIG. 18, the frame assembly 100 includes the control mechanism. The weight of the user is supported by the spaced-apart wheel assemblies 903 positioned in front of the center of gravity and by the auxiliary wheel assembly 906 located behind the center of gravity, and that the spaced-apart caster wheels 930 are not in contact with the supporting surface.

Figure 19:
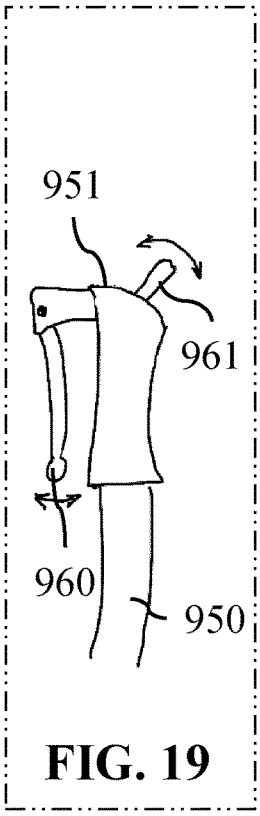
FIG. 19 depicts a side view of an embodiment of the frame assembly of any one of FIG. 7, FIG. 8 and FIG. 9.

FIG. 19 depicts a side view of an embodiment of the frame assembly 100 of any one of FIG. 7, FIG. 8 and FIG. 9.

Referring to the embodiment as depicted in FIG. 19, the frame assembly 100 further includes a control device 950 for utilization with an electric power assist motor (known and not depicted). The brake lever 960 and a throttle lever 961 are attached to the handle 951.

Referring to the embodiment as depicted in FIG. 19, the control device 950 is configured for use with the electrical motor 970 (also called an electric power assist motor). The brake lever 960 and a throttle lever 961 are attached to the handle 951. The operation of these controls are known and not fully described here.

Figure 20:
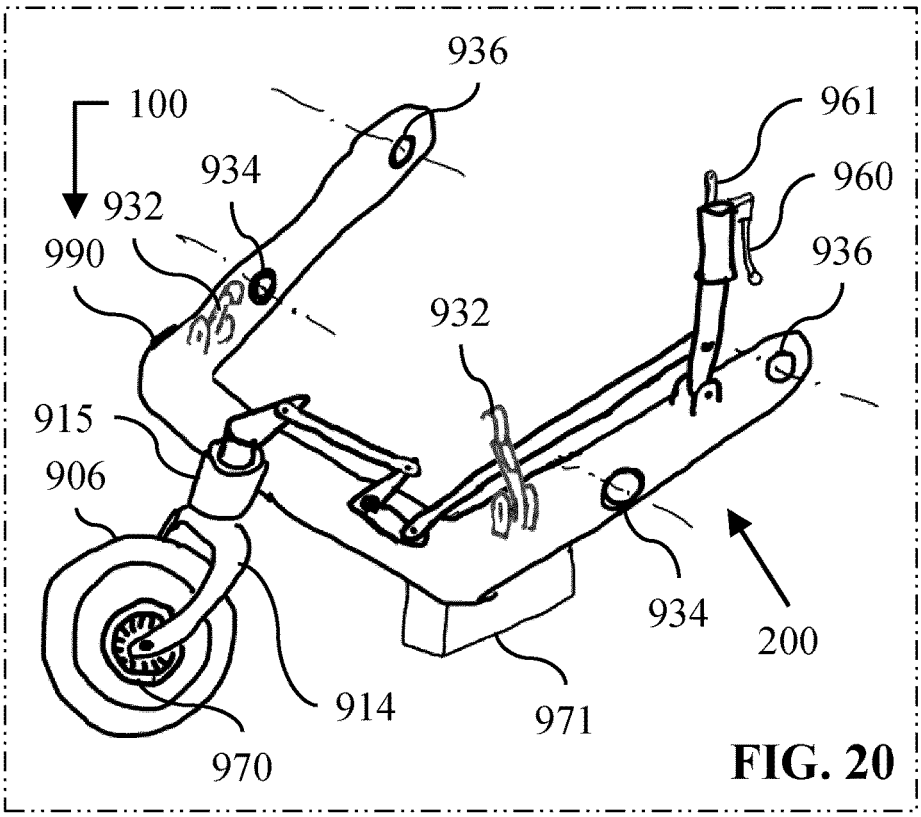
FIG. 20 depicts a side perspective view of an embodiment of the frame assembly of any one of FIG. 7, FIG. 8 and FIG. 9.

FIG. 20 depicts a side perspective view of an embodiment of the frame assembly 100 of any one of FIG. 7, FIG. 8 and FIG. 9.

Referring to the embodiment as depicted in FIG. 20, the auxiliary wheel assembly 906 further includes a power-assisted electrical system, including an electrical motor 970 (also called an electrical hub motor) operatively attached to the auxiliary wheel assembly 906. An electrical battery 971 is mounted to the frame assembly 100. The brake lever 960 and the throttle lever 961 are mounted to the control device 950 (also called a control stick). The electrical wiring and mechanical connection between these components are known and not further described.

In accordance with the embodiment as depicted in FIG. 20, the auxiliary wheel assembly 906 is configured to be rotatably controlled by a steering mechanism. The steering mechanism is configured to control the steering angle of the auxiliary wheel assembly 906. In accordance with an option, an electric assist control device and mechanical brake are provided, which allow the occupant of the frame assembly 100 to switch between power assisted and manual modes of propulsion, as well as to control the direction of motion of the frame assembly 100, power application, and braking force application.

Referring to the embodiment as depicted in FIG. 20, for the case where the frame assembly 100 is equipped with a power assist motor then the control device allows the occupant of the frame assembly 100 to accelerate forward, accelerate backwards, turn left and/or turn right when moving forward, turn left and/or turn right when moving backwards, and apply braking power at any moment (as desired).

Referring to the embodiment as depicted in FIG. 20, for the case where the frame assembly 100 is optionally configured with an electrical motor 970, the control mechanism also provides actuators for the motor power control, and an actuator for a mechanical brake which acts on the auxiliary wheel assembly 906.

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus for a wheelchair assembly, the wheelchair assembly having a seat assembly, spaced-apart wheel assemblies and spaced-apart front caster wheels disposed along a front portion of the wheelchair assembly to move the wheelchair assembly on a supporting surface, the apparatus comprising:

a frame assembly being configured to be selectively connectable with the seat assembly of the wheelchair assembly once the seat assembly is selectively disconnected and removed from the wheelchair assembly; and the frame assembly also being configured to be selectively connectable with the spaced-apart wheel assemblies of the wheelchair assembly once the spaced-apart wheel assemblies are selectively disconnected and removed from the wheelchair assembly, the frame assembly having a pair of spaced-apart prongs including spaced-apart frame connector points to coaxially and selectively attach the spaced-apart wheel assemblies to frontal portions of the pair of spaced-apart prongs, and to selectively attached the seat assembly to the frame assembly such that the spaced-apart front caster wheels disposed along the front portion of the wheelchair assembly are lifted from the supporting surface.

2. The apparatus of claim 1, wherein:

the frame assembly is also configured to be selectively disconnected from the seat assembly of the wheelchair assembly so that the seat assembly is selectively reconnectable with the wheelchair assembly; and the frame assembly is also configured to be selectively disconnected from the spaced-apart wheel assemblies of the wheelchair assembly so that the spaced-apart wheel assemblies are selectively reconnectable with the wheelchair assembly.

3. The apparatus of claim 1, wherein:

the frame assembly is also configured to support an auxiliary wheel assembly; and the auxiliary wheel assembly is spaced apart from the spaced-apart wheel assemblies of the wheelchair assembly once:

the frame assembly, in use, supports the auxiliary wheel assembly; and the spaced-apart wheel assemblies are selectively rotatably mounted to the frame assembly.

4. An apparatus for a wheelchair assembly, the wheelchair assembly having a seat assembly, spaced-apart wheel assemblies and spaced-apart front caster wheels disposed along a front portion of the wheelchair assembly to move the wheelchair assembly on a supporting surface, the apparatus comprising:

a frame assembly; and spaced-apart frame connector points being fixedly attached to, and being supported by the frame assembly; and the spaced-apart frame connector points being configured to be selectively connectable with the seat assembly and with the spaced-apart wheel assemblies of the wheelchair assembly once the seat assembly and the spaced-apart wheel assemblies are selectively disconnected and removed from the wheelchair assembly; and the spaced-apart frame connector points also being configured to be selectively disconnectable from the seat assembly and from the spaced-apart wheel assemblies of the wheelchair assembly so that the seat assembly and the spaced-apart wheel assemblies are selectively reconnectable with the wheelchair assembly, the frame assembly having a pair of spaced-apart prongs extending from end portions of a lateral part of the frame assembly, wherein the spaced-apart frame connector points are disposed on the pair of spaced-apart prongs, the spaced-apart frame connector points comprise:

spaced-apart front axle hubs to coaxially and removably mount the spaced-apart wheel assemblies to frontal portions of the pair of spaced-apart prongs;

spaced-apart rear axle hubs to selectively connect to seat hubs at the end of a seat axle of the seat assembly with the frame assembly;

spaced-apart seat-connector assemblies configured be selectively attached to a seat frame of the seat assembly such that the spaced-apart front caster wheels disposed along the front portion of the wheelchair assembly are lifted from the supporting surface.

5. The apparatus of claim 4, wherein:

the frame assembly is configured to support an auxiliary wheel assembly in a spaced-apart relationship relative to the spaced-apart wheel assemblies once the spaced-apart wheel assemblies are selectively rotatably mounted to the frame assembly; and an auxiliary rotation axis of the auxiliary wheel assembly is spaced apart from a common rotation axis extending between the spaced-apart wheel assemblies once:

the frame assembly, in use, supports the auxiliary wheel assembly; and the spaced-apart wheel assemblies, in use, are selectively rotatably mounted to the frame assembly.

6. The apparatus of claim 5, wherein:

the frame assembly includes the pair of spaced-apart prongs; and the spaced-apart wheel assemblies are mountable to the pair of spaced-apart prongs of the frame assembly so that the auxiliary wheel assembly and a centre of gravity are located behind the spaced-apart wheel assemblies.

7. The apparatus of claim 4, wherein:

the frame assembly includes a U-shaped frame.

8. The apparatus of claim 7, wherein:

the U-shaped frame is configured to support an auxiliary wheel assembly;

the spaced-apart wheel assemblies are coaxially mountable to the frontal portion of the U-shaped frame, and the spaced-apart wheel assemblies, in use, share a common rotation axis that extends through the frontal portion of the U-shaped frame.

9. The apparatus of claim 4, wherein:

the spaced-apart frame connector points include spaced-apart seat connector points being fixedly attached to, and being supported by the frame assembly, the seat assembly includes spaced-apart seat-connection points; and the spaced-apart seat connector points being configured to be respectively selectively connectable to, and disconnectable from, the spaced-apart seat-connection points of the seat assembly of the wheelchair assembly once the seat assembly is selectively disconnected from the wheelchair assembly.

10. The apparatus of claim 4, wherein:

the spaced-apart frame connector points include spaced-apart wheel connector points being fixedly attached to, and being supported by the frame assembly, the spaced-apart wheel assemblies include spaced-apart wheel-connection points; and the spaced-apart wheel connector points being configured to be respectively selectively rotatably connectable to, and disconnectable from, the spaced-apart wheel-connection points of the spaced-apart wheel assemblies once the spaced-apart wheel assemblies are selectively disconnected from the wheelchair assembly.

11. The apparatus of claim 10, wherein:

the spaced-apart wheel assemblies are aligned coaxially and share, in use, a common rotation axis once:

the spaced-apart wheel assemblies are disconnected from the wheelchair assembly; and the spaced-apart wheel connector points, in use, selectively rotatably connect the frame assembly to the spaced-apart wheel-connection points of the spaced-apart wheel assemblies.

12. An apparatus for a wheelchair assembly, the apparatus, comprising:

a frame assembly being configured for utilization with components of the wheelchair assembly having a seat assembly, a wheel assembly having spaced-apart wheel assemblies, and spaced-apart front caster wheels disposed along a front portion of the wheelchair assembly to move the wheelchair assembly on a supporting surface, in which the spaced-apart wheelchair assemblies includes a first wheel assembly and a second wheel assembly, and in which the first wheel assembly and the second wheel assembly are configured to be selectively disconnectable from the wheelchair assembly, and in which the wheelchair assembly includes the seat assembly configured to be selectively disconnectable from the wheelchair assembly; and the frame assembly including:

an elongated tubular frame member; and a first wheel mount extending from the elongated tubular frame member; and the first wheel mount being configured to rotatably receive and support the first wheel assembly of the wheelchair assembly once the first wheel assembly is selectively disconnected from the wheelchair assembly; and a second wheel mount extending from the elongated tubular frame member; and the second wheel mount being configured to rotatably receive and support the second wheel assembly of the wheelchair assembly once the second wheel assembly is disconnected from the wheelchair assembly; and the second wheel mount and the first wheel mount being spaced apart from each other; and a third wheel tubular mount extending from the elongated tubular frame member; and the third wheel tubular mount being configured to rotatably receive and support an auxiliary wheel assembly at a spaced-apart relationship relative to the first wheel assembly and the second wheel assembly of the wheelchair assembly, the frame assembly having a pair of spaced-apart prongs extending from end portions of a lateral part of the frame assembly, wherein the spaced-apart frame connector points are disposed on the pair of spaced-apart prongs, the spaced-apart frame connector points comprise:

spaced-apart front axle hubs to coaxially and removably mount the spaced-apart wheel assemblies to frontal portions of the pair of spaced-apart prongs;

spaced-apart rear axle hubs to selectively connect to seat hubs at the end of a seat axle of the seat assembly with the frame assembly;

spaced-apart seat-connector assemblies configured be selectively attached to a seat frame of the seat assembly such that the spaced-apart front caster wheels disposed along the front portion of the wheelchair assembly are lifted from the supporting surface.

13. The apparatus of claim 12, wherein:

the first wheel assembly and the second wheel assembly are spaced apart from each other once:

the first wheel assembly is rotatably mounted to the first wheel mount; and the second wheel assembly is rotatably mounted to the second wheel mount.

14. The apparatus of claim 12, wherein:

the first wheel assembly and the second wheel assembly are coaxially aligned with each other so that a rotation axis extends between the first wheel assembly and the second wheel assembly once:

the first wheel mount, in use, rotatably supports the first wheel assembly; and the second wheel mount, in use, rotatably supports the second wheel assembly.

15. The apparatus of claim 12, wherein:

the auxiliary wheel assembly is rotatable along an auxiliary rotation axis extending between the first wheel assembly and the second wheel assembly once:

the first wheel mount, in use, rotatably supports the first wheel assembly; and the second wheel mount, in use, rotatably supports the second wheel assembly; and the third wheel tubular mount, in use, receives and supports the auxiliary wheel assembly.

16. The apparatus of claim 12, wherein:

the elongated tubular frame member is configured to locate and support the seat assembly between the auxiliary wheel assembly and a common rotation axis extending through the first wheel assembly and the second wheel assembly.

17. The apparatus of claim 12, further comprising:

a seat-connector assembly being configured to selectively connect the elongated tubular frame member and the seat assembly with each other; and the seat-connector assembly also being configured to selectively disconnect the elongated tubular frame member and the seat assembly from each other.

18. The apparatus of claim 17, wherein:

the seat assembly, in use, faces toward the first wheel assembly and the second wheel assembly once the seat-connector assembly, in use, selectively connects the elongated tubular frame member and the seat assembly with each other.

19. The apparatus of claim 17, wherein:

the seat assembly, in use, faces away from the first wheel assembly and the second wheel assembly once the seat-connector assembly, in use, selectively connects the elongated tubular frame member and the seat assembly with each other.

20. The apparatus of claim 12, wherein:

the frame assembly is further configured to support a steering control assembly, in which the steering control assembly is configured to be movable forward and rearward relative to the seat assembly, and in which the steering control assembly is also configured to steer the first wheel assembly and the second wheel assembly left and right.

* * * * *